US005293742A

United States Patent [19]

Gillingham et al.

[11] Patent Number: 5,293,742

[45] Date of Patent: Mar. 15, 1994

[54] TRAP APPARATUS WITH TUBULAR FILTER ELEMENT

[75] Inventors: Gary R. Gillingham, Prior Lake; James C. Rothman, Burnsville; Kelly C. Robertson, Rosemount; Marty A. Barris, Lakeville; Peter Betts, Prior Lake; Wayne M. Wagner, Apple Valley, all of Minn.

[73] Assignee: Donaldson Company, Inc., Minneapolis, Minn.

[21] Appl. No.: 47,772

[22] Filed: Apr. 14, 1993

Related U.S. Application Data

[63] Continuation of Ser. No. 722,598, Jun. 27, 1991, abandoned.

[51] Int. Cl.[5] ..... F01N 3/02

[52] U.S. Cl. ..... 60/288; 60/303; 60/311; 55/466; 55/DIG. 30

[58] Field of Search ..... 60/274, 288, 303, 311; 55/DIG. 30, 466, 523

[56] References Cited

U.S. PATENT DOCUMENTS

| | | | |
|---|---|---|---|
| 3,843,561 | 10/1974 | Sobel . | |
| 3,898,063 | 8/1975 | Gazan . | |
| 4,264,344 | 4/1981 | Ludecke et al. . | |
| 4,281,512 | 8/1981 | Mills . | |
| 4,373,330 | 2/1983 | Stark . | |
| 4,386,497 | 6/1983 | Takagi et al. . | |
| 4,419,113 | 12/1983 | Smith . | |
| 4,427,418 | 1/1984 | Kogiso et al. . | |
| 4,436,535 | 3/1984 | Erdmannsdörfer et al. . | |
| 4,455,823 | 6/1984 | Bly et al. . | |
| 4,478,618 | 10/1984 | Bly et al. . | |
| 4,485,622 | 12/1984 | Takagi et al. . | |
| 4,512,147 | 4/1985 | Wong . | |
| 4,535,588 | 8/1985 | Sato et al. . | |
| 4,573,317 | 3/1986 | Ludecke | 60/311 |
| 4,573,317 | 3/1986 | Ludecke . | |
| 4,625,511 | 12/1986 | Scheitlin et al. . | |
| 4,629,483 | 12/1986 | Stanton . | |
| 4,641,496 | 2/1987 | Wade . | |
| 4,732,594 | 3/1988 | Mizrah et al. . | |
| 4,788,819 | 12/1988 | Henkel . | |
| 4,791,785 | 12/1988 | Hudson et al. . | |
| 4,829,766 | 5/1989 | Henkel | 60/311 |
| 4,851,015 | 7/1989 | Wagner et al. . | |
| 4,916,897 | 4/1990 | Hayashi et al. . | |
| 5,002,666 | 3/1991 | Matsumoto et al. . | |
| 5,009,065 | 4/1991 | Howe et al. . | |
| 5,024,054 | 6/1991 | Barris et al. . | |
| 5,052,178 | 10/1991 | Clerc . | |
| 5,074,112 | 12/1991 | Walton | 60/311 |
| 5,138,836 | 8/1982 | Pfister . | |

FOREIGN PATENT DOCUMENTS

| | | | |
|---|---|---|---|
| 0275372 | 7/1988 | European Pat. Off. . | |
| 0395840 | 11/1990 | European Pat. Off. . | |
| 8701816 | 4/1987 | Fed. Rep. of Germany . | |
| 3638203 | 5/1988 | Fed. Rep. of Germany . | |
| 60-22016 | 2/1985 | Japan . | |
| 153415 | 8/1985 | Japan | 60/295 |
| 68712 | 3/1988 | Japan | 60/295 |
| 8707324 | 12/1987 | World Int. Prop. O. . | |

OTHER PUBLICATIONS

SAE Article 840174, "Particulate Control Technology and Particulate Standards for Heavy Duty Diesel Engines", Christopher S. Weaver, pp. 109-125, in particular, FIG. 5.

*Primary Examiner*—Douglas Hart

*Attorney, Agent, or Firm*—Merchant, Gould, Smith, Edell, Welter & Schmidt

[57] ABSTRACT

A muffler-filter apparatus having a particulate trap using filter tubes with high temperature filter materials, like fiber in the form of yarn, woven yarn mat, or a non-woven, random array fiber mat, or various foams. Filter tubes have various structural configurations and are regenerated by axial propagation using ring heaters or stub rod heaters, by heating the entire length of the filter tube with a rod heater or some other full-length heater configuration. For regeneration, exhaust flow is bypassed using various valve configurations including a poppet valve, a shutter valve, or a tubular valve. Filter tube filters may also be self-regenerated by the heat from the exhaust gases as controlled by a throttle valve or on inclusion of fuel additives which lower particulate ignition temperature.

31 Claims, 19 Drawing Sheets

FIG. 4
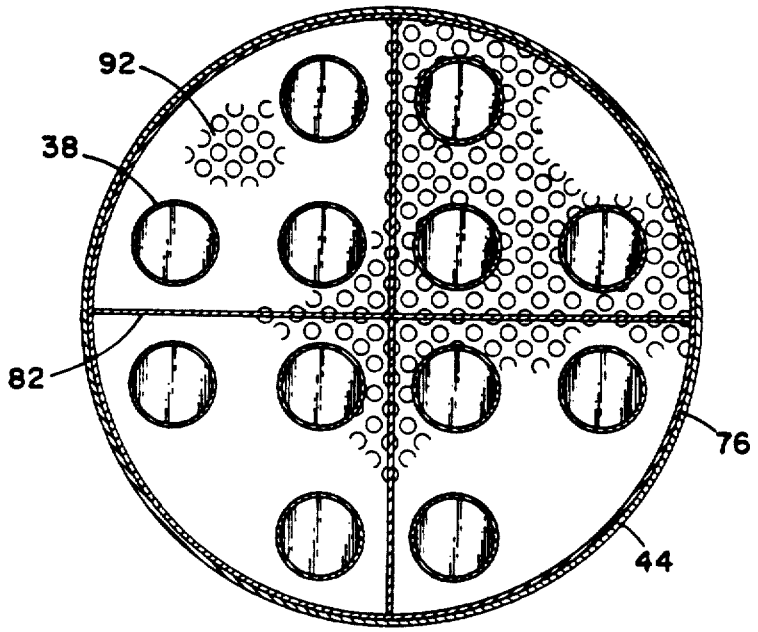
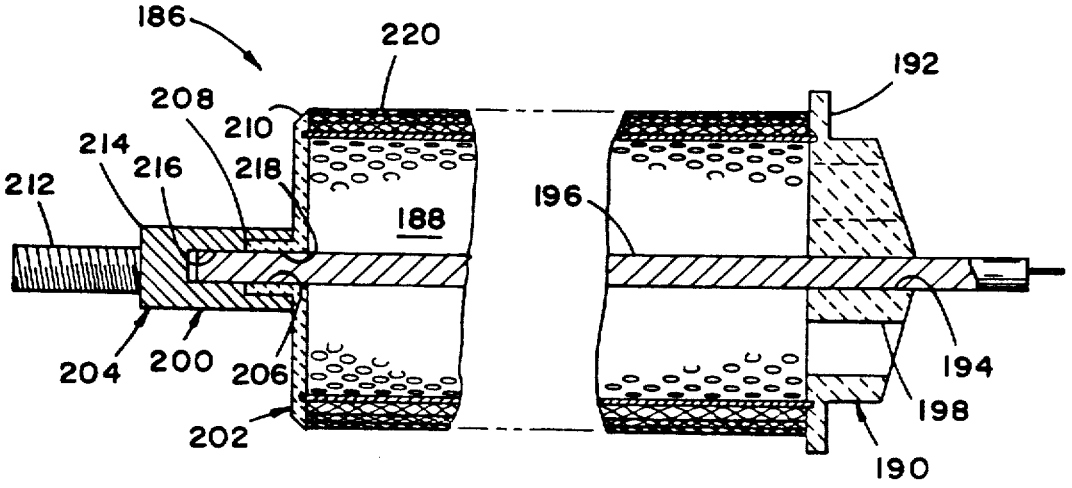
FIG. 7

TRAP APPARATUS WITH TUBULAR FILTER ELEMENT

This is a continuation of application Ser. No. 07/722,598, filed Jun. 27, 1991, now abandoned.

FIELD OF THE INVENTION

The invention is directed generally to trap devices for filtering particulates from exhaust gases of engines, primarily diesel engines in vehicles.

BACKGROUND OF THE INVENTION

Particulate emissions (black smoke) from diesel engines is significant. Diesel particulate material strongly absorbs light and leads to degraded visibility, particularly when there are several diesel-engine vehicles in an area. Diesel particulate material furthermore is easily respirated and is consequently of concern since it potentially includes mutagenic and carcinogenic chemicals. As a result of these and other reasons, various levels of governments regulate particulate emissions from diesel engines.

In response to the need to reduce engine particulate emissions, vehicle and engine manufacturers are attempting both to develop engines which produce cleaner exhaust and to develop particulate trap systems which clean the exhaust before emission to atmosphere. The latter approach is relevant to the present invention. The latter approach in general uses a device known as a trap-oxidizer. A trap-oxidizer system generally includes a temperature resistant filter (the trap) from which particulates are periodically burned off (oxidized), a process commonly known as regeneration. The traps must be regularly regenerated so as not to become excessively loaded and create an undesirable back pressure thereby decreasing engine efficiency.

Possible traps for capturing diesel particulate emissions primarily include cellular ceramic elements (see U.S. Pat. No. 4,276,071) and catalytic wire-mesh devices (see U.S. Pat. No. 3,499,269).

Trap-oxidizer regeneration systems can be divided into two major groups primarily on the basis of control philosophy. One group is positive regeneration systems; the other group is self-regeneration systems. Positive regeneration systems include the use of a fuel-fed burner (see U.S. Pat. No. 4,167,852), use of an electric heater (see U.S. Pat. No. 4,851,015) or use of techniques which aim to raise the temperature of exhaust gas temperature at selected times (see U.S. Pat. No. 4,211,075). Self-regeneration systems are directed, for example, to the use of catalytic treated traps to lower the ignition temperature of the captured particulates.

Currently, a popular trap is one which uses a cellular ceramic element and a popular regeneration method is one which uses a face electric heater to initiate regeneration of the trap. Although such trap and method can serve the particulate cleaning purpose well, cellular ceramic elements are subject to failure by cracking due usually to heat gradients caused by uneven burns, and experience with cellular ceramic/electric heater systems also makes it clear that it would be a distinct advantage to have a system which reduced the requirements of vehicular supplied power. The present invention, in its various embodiments, provides improved performance in these areas.

SUMMARY OF THE INVENTION

The present invention is directed to apparatus requiring a housing, a plurality of filtering means, regenerating mechanism, and mechanism for controlling the regenerating mechanism. The plurality of filtering means is within the housing along a fluid flow path leading from the upstream housing inlet to the downstream housing outlet. Each filtering means includes a module having an open interior for flow of exhaust gases and a wall with filter material. The apparatus further includes mechanism for supporting the modules relative to the housing so that each wall with filter material has open space thereabout for flow of exhaust gases. The regenerating mechanism provides for selective regeneration at any time of at least one and less than all of the plurality of filtering means at a time when exhaust gases are bypassing through non-regenerating filtering means along the fluid flow path.

The filtering means module is in the form of a filter tube. Although filter tubes have been used to filter diesel exhaust particulates, the present invention advantageously shows structure for creating an internal bypass which allows for electrical regeneration of bypassed tubes (i.e., positive regeneration where needed while maintaining full flow filtration). And although catalyst treated yarn filter tubes have been used for self-regeneration, the present invention even more advantageously shows the use of catalysts in the fuel burned by the engine to aid in downstream regeneration of the filter tubes.

The improved filter tube system provides significant safety and durability advantages over non-filter tube prior art. That is, regeneration combustion of filter tubes requires much less power resulting in much less heat at any specific time. With respect to durability, cellular ceramic monoliths begin regeneration at high temperatures and depending on the uniformity of burn, the exotherm of the reaction can lead to trap damage via cracking or melting. The use of filter tubes, particularly fibrous tubes, alleviates the problem by allowing hot portions of the filter to expand freely. Thermal stresses are not generated and therefore cracks are not possible. Additionally, material is available having higher ultimate melting temperatures than the common ceramics used in filter monoliths.

Another advantage of tubular filter geometry is that if depth loading is designed into the filter structure, the exotherm of the regeneration reaction will be absorbed by the entire mass of the filter tube. As more mass is used to absorb the released energy, the peak temperature during regeneration is decreased. The result being that the tubular filter design with distributed loading can be loaded over a wider range of mass without the danger of regeneration induced damage.

Also, the design of this invention allows the tubular filters to expand freely in the axial direction during any thermal growth period, such as: regeneration and high temperature operation. This free expansion alleviates thermal stresses due to the filter's thermal expansion properties. The thermally induced stresses on the entire filter tube are decreased by allowing one end limited axial motion relative to the fixed opposite end.

The relatively thin wall of the tubular filter design provides an additional advantage with regard to thermal stress. Since the wall cross-section is a small dimension compared to the tube's length, the wall's temperature is more uniform during a regeneration of the tube.

More uniform temperature results in decreased thermal gradients, and as a consequence, decreased thermal stresses. As a result, the filter tube again can be loaded over a wider range of mass with decreased potential for damage during regeneration.

Furthermore, structure allowing for bypass of some filter tubes for regeneration while others continue to filter results in a decreased system power requirement. Also, the ability to bypass within a single housing provides space and mounting advantages. This contrasts with systems bypassing into a separate bypass muffler or other separate filtration housing. The present invention thus brings together a unique combination of reduced power for electrical regeneration with full time filtration and durability, as well as integrated acoustic performance.

The present invention is directed preferably to filtering material using ceramic or metallic fibers. In this regard, it is directed not only to filter tubes having one or more ordered layers of single strand ceramic fiber, but also to filter tubes having one or more layers of either a non-woven, random array matting of ceramic fibers or a woven mat of ceramic fibers. Alternatively, a metallic fiber could be used in any of the indicated forms. Also, porous materials including ceramic and metallic foams could be used.

In addition, the electrical heaters for regeneration of filter tubes in accordance with the present invention can take a variety of forms, including a ring in close proximity to or in contact with the ceramic fiber and located at one end of the fiber filter tube, a rod extending axially into the filter tube, a structural member for supporting the ceramic fiber wherein the structural member also functions as the heater, or a distributed heater such as a screen formed between layers of ceramic fiber comprising the filter tube.

As well as various forms of electric heaters for heating particulates on individual filter tubes to achieve regeneration, the present invention also provides structure which advantageously energizes particular heater designs. In particular, various poppet valve embodiments allow not only for flow control of exhaust gases, but also function as a switch mechanism to energize or de-energize an electrical heater, as appropriate.

In addition, the present invention shows that tubular or shutter valves in contrast to poppet valves, may be used to control flow among various secondary flow paths. Furthermore, flow can be controlled by a valve external of a particular canister housing to accommodate situations where multiple filter canisters are desired.

Also, the present invention need not include an electrical heater if a throttle valve is used to appropriately control the heat of exhaust gases or if a catalyst is metered into the fuel supply to the engine or is premixed for metering as a mixture to the engine.

Thus, the present invention is disclosed to have several embodiments of several features. The invention is, consequently, best understood by reference to the drawings and the detailed description, both of which follow.

BRIEF DESCRIPTION OF THE DRAWINGS

FIG. 4 is a cross-sectional view taken along line 4—4 of FIG. 1;

FIG. 7 is a cross-sectional view of a filter tube having a rod heater;

DETAILED DESCRIPTION OF THE PREFERRED EMBODIMENT

Figure 1:
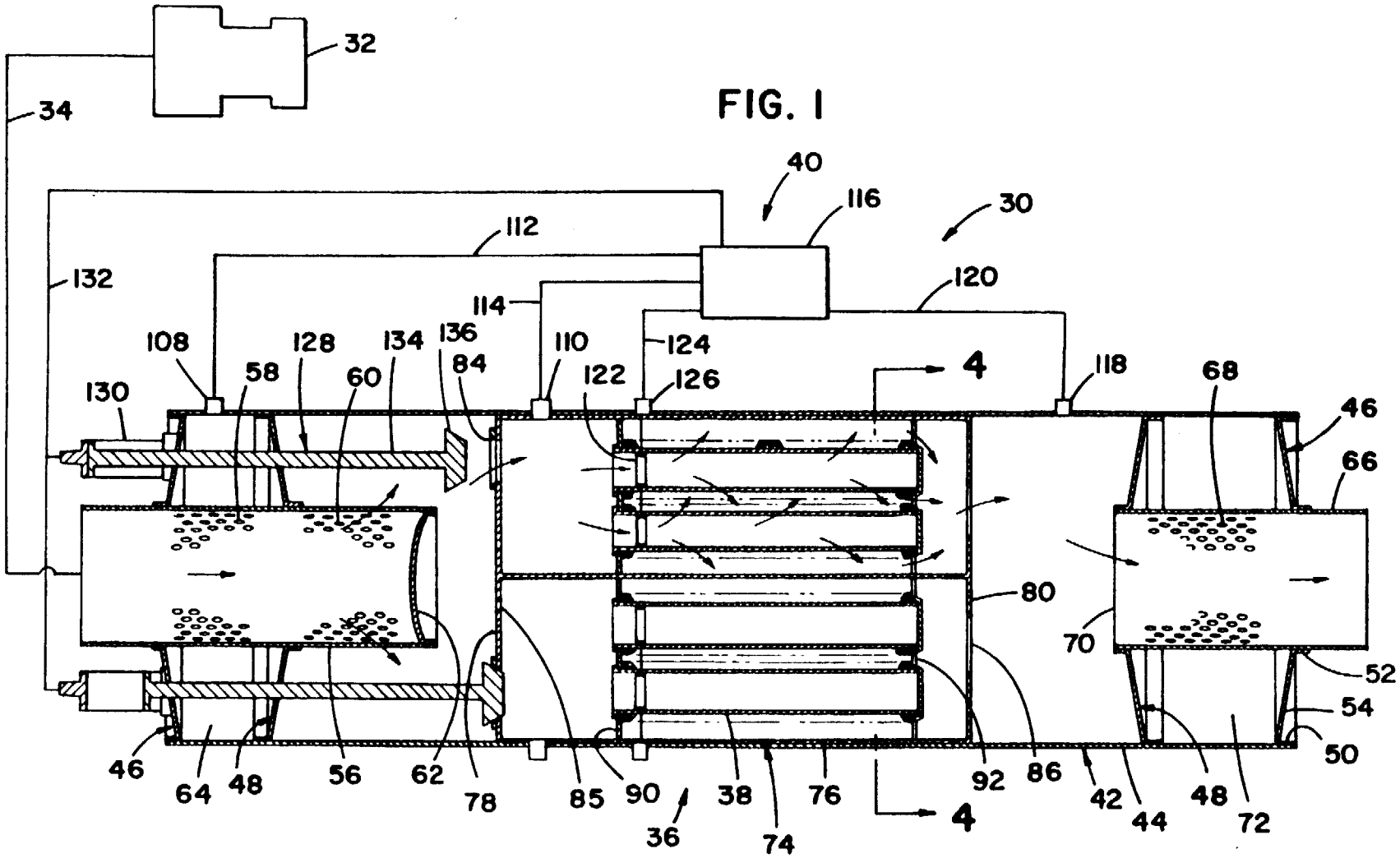
FIG. 1 illustrates an exhaust system in accordance with the present invention, including a cross-sectional view of muffler-filter apparatus along with a schematically illustrated control system for the apparatus.

Referring now to the drawings wherein like reference numerals designate identical or corresponding parts throughout the several views, and more particularly to FIG. 1, a system for processing exhaust gases from an engine in accordance with the present invention is designated generally by the numeral 30.

System

Preferred system 30 is in fluid communication with engine 32 to receive exhaust gases therefrom via line 34. System 30 includes a muffler-filter apparatus 36 which has a plurality of filter tubes 38. The regeneration of filter tubes 38 is accomplished via control mechanism 40.

Apparatus 36 includes a housing 42 comprising a cylindrical wall 44 with opposite end walls 46 and interior baffle members 48. Each of end walls 46 and baffle members 48 are formed to have an outer circular flange 50 to be fastened to wall 44 along its interior and are also formed to have an inner circular flange 52 which forms an axially aligned opening. The wall 54 extending between flanges 50 and 52 is preferably formed to have a symmetric curvature to provide appropriate structural strength.

An inlet pipe 56 is attached to and held by flanges 52 of the left-most pair of end wall 46 and baffle member 48 as shown in FIG. 1. Pipe 56 is welded or otherwise fastened to be a part of line 34. Inlet pipe 56 is perforated with a plurality of first openings 58 in a region between end wall 46 and baffle member 48 and is also perforated with a set of second openings 60 in a region between baffle member 48 and closure end member 62 of inlet pipe 56. In this way, the chamber 64 formed between end wall 46 and baffle member 48 functions acoustically as a resonating chamber since openings 58 allow exhaust gases to flow therethrough and be muffled therein.

Similarly, an outlet pipe 66 is attached to and is held by inner flanges 52 of the right-most pair of end wall 46 and baffle member 48 as shown in FIG. 1. Outlet pipe 66 is fastened to an exhaust tail pipe (not shown). Outlet pipe 66 includes a plurality of third openings 68 so that gases entering interior end 70 may flow through openings 68 and be muffled within chamber 72 which then also functions acoustically as a resonating chamber.

Housing 42 is then an enclosure having an inlet at inlet pipe 56 and an outlet at outlet pipe 66 with a first fluid flow path leading from the inlet upstream to the outlet downstream for passing the exhaust gases therealong. Housing 42 has acoustic elements along the fluid flow path which provide interaction with the exhaust gases in conjunction with both inlet and outlet pipes 56 and 66. The filtering mechanism is provided within housing 42 between the acoustic elements.

In this regard, the term acoustic element is recognized by those skilled in the art to include reactive, passive absorptive, or dissipative attenuation. A reactive acoustic element is understood to mean anything designed to attenuate sound by phase cancellation due to reflections so that one sound wave cancels another by approaching the other (e.g., a resonating chamber). Reactive attenuation is contrasted with passive, absorptive attenuation where amplitude is damped with interaction with another medium. The previous methods are further contrasted with dissipated attenuation (e.g., a labyrinth or an enlarged chamber) wherein sound is decreased primarily by expansion, and not so much by phase cancellation or absorption. It is understood that an inventive apparatus need not have multiple acoustic elements, but rather the exhaust system ordinarily requires a design sufficient to accomplish the noise attenuation desired, i.e., any acoustic element could be in a housing separate from a housing containing filter tubes.

Figure 2:
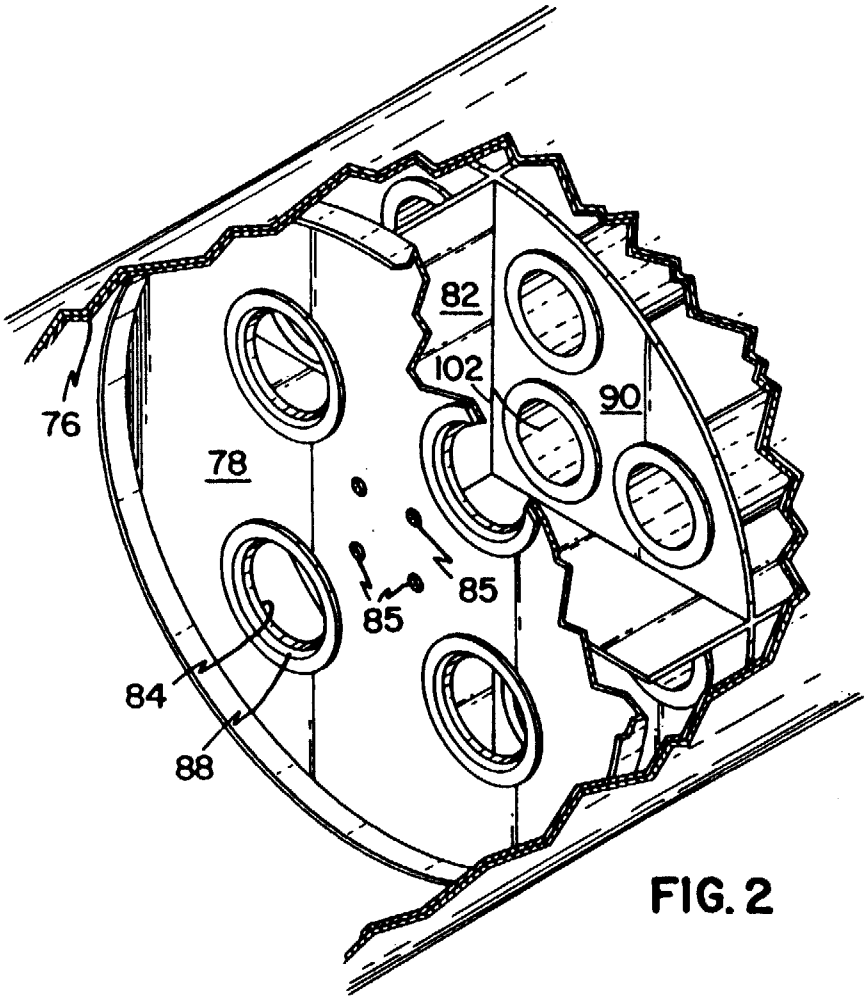
FIG. 2 is a partially cut-away perspective view of one end of a second housing as installed in the muffler-filter apparatus of FIG. 1.

Although a second housing 74 containing filtering mechanism as fastened by weld or other known mechanism within wall 44 between baffle members 48 is shown, a preferred structure eliminates certain portions of the second housing as described hereinafter. With reference to FIG. 2, second housing 74 comprises a cylindrical wall 76 with upstream and downsteam opposite end walls 78 and 80. Second housing 74 is segmented by walls 82 which are perpendicular with respect to one another and extend between end walls 78 and 80 to divide second housing 74 into quadrants. Although second housing 74 is shown divided into quadrants, it is understood that a different number of divisions may be equally appropriate. Each quadrant has an upstream opening 84 in end wall 78 and a downstream opening 86 in end wall 80. Upstream openings 84 are formed in a thickened member or a boss so as to provide an inclined valve seat 88. Small secondary openings 85 are also provided in end wall 78 and lead to each quadrant to provide combustion oxygen for regeneration as explained more fully hereinafter. A plate member 90 is spaced from upstream end plate 78 and provides one end support for filter tubes 38. Plate member 90 is appropriately attached to cylindrical wall 76 and segmenting walls 82. A perforated plate 92 is spaced from downstream end plate 80 and provides another end support for filter tubes 38.

Since walls 82 are impermeable and extend between upstream and downstream ends 78 and 80, second fluid flow paths are separated from one another and are formed from second inlets at openings 84 to second outlets at openings 86. As will become apparent, at least one of the second inlets, but less than all of the second inlets can be closed at any time to allow exhaust gases flowing along the first fluid flow path to continue to pass along at least one of the second fluid flow paths through the second housing. The closed second fluid flow path is then available for regeneration of filter tubes 38 therein.

Second housing 74 can aid in assembly of muffler-filter apparatus 36. As indicated earlier, however, second housing 74 is not a necessity. Although end wall 78 is generally preferred to provide valve seats if poppet valves are the valve of choice for directing flow among the various second flow paths and impermeable walls 82 are preferred to divide the various second flow paths, cylindrical wall 76 and downstream end wall 80 are not necessary, for example, to achievement of equivalent function of muffler-filter apparatus 36.

Figure 3:
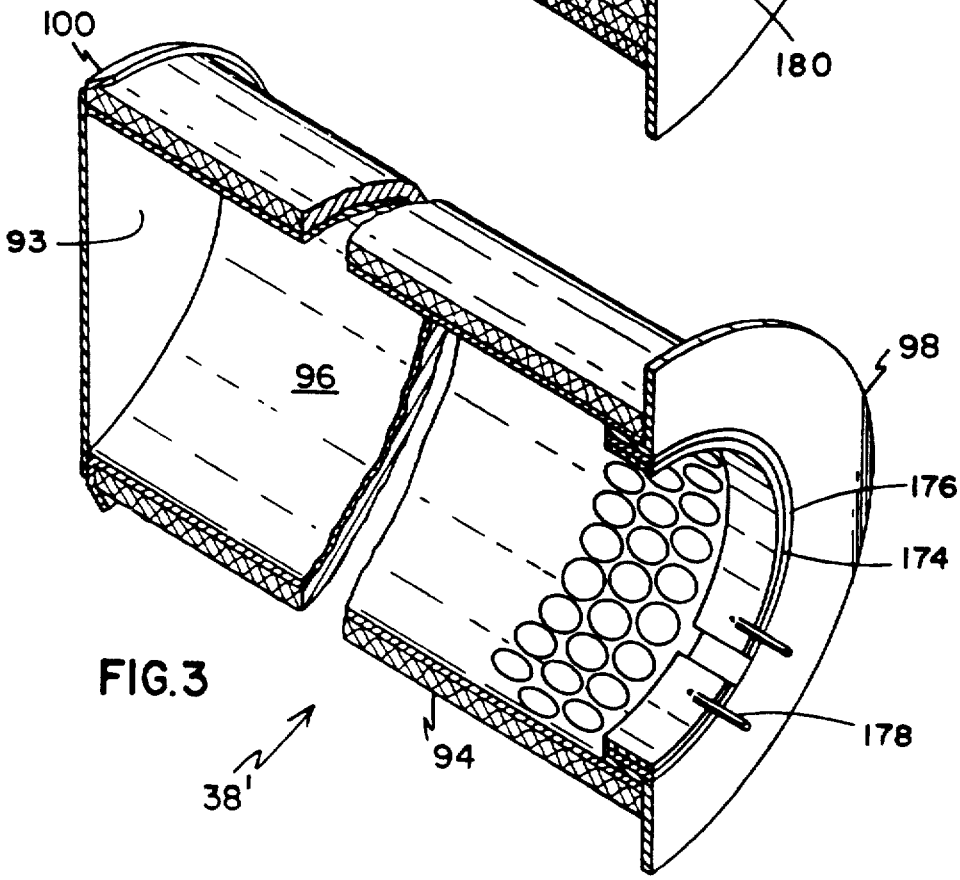
FIG. 3 is a partially cut-away perspective view of a filter tube in accordance with the present invention.

Second housing 74 contains a plurality of filter modules 38. With reference to FIG. 3, filter module 38' includes a layer of ceramic fiber in the form of yarn 94 wound about a perforated tube 96 which serves as structural support for the fiber. Upstream and downstream opposite end members 98 and 100 are attached to or formed as a part of perforated tube 96 and not only provide end retaining walls for the wound fiber, but can provide a mechanism for holding module 38 relative to plate member 90 and perforated plate 92 in second housing 74. Closure plate 93 is welded or otherwise attached or formed as a part of end member 100. As shown, filter tube module 38' is installed in second housing 74 by inserting end member 100 and the rest of module 38' through plate member 90 until end member 100 contacts perforated plate 92 and is held thereby. End member 98 should then just contact plate member 90 and be tack welded or otherwise fastened thereto. Upstream end member 98 is a flat ring to make flush contact with plate member 90. Downstream end member 100 extends outwardly from perforated tube 96 and can then be inclined toward upstream end member 98 or otherwise to provide a retaining curvature for fiber 94. Exhaust gases flow into the central opening 102 of module 38'. Closure plate 93 plugs the downstream central opening of module 38' thereby forcing the exhaust gases to flow through perforated tube 96 and the ordered layer of ceramic fiber yarn 94 before flowing past perforated plate 92.

As shown in FIG. 4, perforated plate 92 extends across the cylindrical space in side wall 76 to the various impermeable walls 82. Perforated plate 92 supports the downstream ends of the various filter tubes 38'. Perforated plate 92 is formed to receive end members 100 or is otherwise attached to filter tubes 38'. Exhaust gases which have been filtered by flowing from inside filter tube 38' to outside of them continue to flow through perforated plate 92 toward outlet pipe 66.

Since filter tubes 38 are exceedingly durable, an elaborate control system as is needed for most ceramic monolith filter systems, is not needed for system 30. Rather, a simple timing system can be used wherein filter tubes 38 in a particular quadrant are regenerated after a predetermined filtering time has elapsed. Less than all and preferably only one quadrant of filter tubes are regenerated at a time. Alternately, a control system which measures pressure drop across each quadrant may also be used to determine when regeneration is necessary. Such a system is shown in FIG. 1.

In this regard, a baseline differential pressure is obtained with pressure transducers 108 and 110 which are connected via lines 112 and 114 to processing unit 116. Pressure transducer 110 is located in one of the quadrants of the second housing. It is understood that there is a pressure transducer 110 for each of the quadrants. As shown in FIG. 1, the baseline pressure differential is the pressure drop across inlet pipe 56 and plate 78 of the exhaust flow through perforations 58 on one side and perforations 60 and opening 84 on the other side.

Differential pressure across filter tubes 38 in each quadrant is obtained with one of the pressure transducers 110 and pressure transducer 118. A signal corresponding to the pressure read from transducer 118 is sent to processor 116 via line 120. Processor 116 is connected to an appropriate power source. The processor 116 calculates the ratio of baseline differential pressure to trap differential pressure. The ratio is compared to a predetermined value. If the ratio is less than the predetermined value, then measurements and calculations continue. If the ratio is greater than the predetermined value, and if the engine is running so that exhaust is flowing, regeneration is initiated.

To initiate regeneration, processor 116 energizes the various heating elements 122 for the filter tubes in the quadrant to be regenerated. Various heating elements 122 are disclosed hereinafter. Processor 116 is connected to the heating elements via line 124 through fitting 126. At about the same time as heaters 122 are energized, processing unit 116 causes poppet valve 128 to close via solenoids 130 and line 132. With poppet valve 128 closed, exhaust gases bypass the closed quadrant so that the heating elements are allowed to function as designed and initiate combustion of the particulates on the filter tubes in the closed quadrant. Bypassing of the exhaust gases allows for a more controlled environment during regeneration and minimizes the likelihood of premature quenching of non-combusted particulates. Oxygen for combustible regeneration is provided by oxygen remaining in exhaust gases leaking through the appropriate opening 85.

Poppet valve 128 has a stem 134 which is supported and guided by appropriate openings in end wall 46 and baffle member 48. The outer end of stem 134 interacts with solenoid 130 in a fashion known to those skilled in the art. The head 136 of poppet valve 128 closes into seat 88 when appropriate as indicated hereinbefore. Alternate embodiment poppet valve assemblies are described more fully hereinafter.

A fuller discussion of a control system based on differential pressure determinations can be found in U.S. Pat. No. 4,851,015, incorporated herein by reference.

In use, exhaust gases from engine 32 flow through line 34 into inlet pipe 56. Sound is muffled at resonating chamber 64. The exhaust gases flow from perforations 60 through open poppet valve openings 84 into the various quadrants of the second housing 74. The exhaust gases flow into the open upstream ends 102 of filter tubes 38. Since the downstream ends are closed by closure plates 93, the exhaust gases flow out the walls of filter tubes 38 and through perforated plate 92 and openings 86 to outlet pipe 66. Sound is again muffled at resonating chamber 72.

When the control system determines that the filter tubes 38 in one of the quadrants satisfy the predetermined criteria for regeneration, the heating elements for the filter tubes in that quadrant are turned on and the poppet valve is closed. The heating elements stay on a predetermined time or until combustion is sensed to have begun and/or ended. In accordance with the design parameters of the particular heating element, particulate combustion is initiated and regeneration of the filter tubes proceeds until combustion extinguishes. An acceptable level of oxygen is leaked into the regenerating quadrant through an opening 85. After an appropriate poppet valve closure time, processing unit 116 opens the poppet valve and the regenerated filter tubes are again available for filtration.

System 30 advantageously provides for filter tubes in at least one of the quadrants, but not all, to be regenerated while filter tubes in the other quadrants are available for filtration. In this way, back pressure to the engine is kept to a minimum and exhaust gases are always filtered and never completely bypassed. System 30 can be contrasted with non-filter tube prior art systems which most commonly are bypassed from one filtration housing to a muffler or possibly to a second filtration housing.

Filter Tube Embodiments

As discussed hereinbefore with reference to FIG. 3, filter module 38' includes a layer of filter material 94 wrapped or formed about a perforated tube 96 which serves as a support for the filter material. Upstream and downstream opposite end members 98 and 100 are attached to or formed as a part of perforated tube 96 and provide both end retaining walls for the filter material and a mechanism for holding the module relative to a housing containing it. Closure plate 93 plugs the downstream central opening. One of various heating elements is attached as discussed hereinafter to provide for regeneration.

Filter tubes are constructed to provide for various types of particulate loading. That is, a filter tube may be constructed to provide surface loading. A filter tube may also be constructed to provide a more uniform depth loading. Because filter tubes may be constructed with ceramic fiber yarn, a woven matting from ceramic or metallic fiber or a non-woven, random array of fibers entangled together or bonded with a separate binder into a mat, or ceramic or metallic foams, a good parameter for specifying filter properties so as to create surface or depth loading is volume solidity. Volume solidity is defined as a ratio of filter material volume to the total filter medium volume under consideration. Thus, if the volume solidity is relatively high near the upstream filter surface, there will be more surface loading. If the volume solidity is lower near the upstream surface and increases away in the direction of flow, there will be more depth loading. Filter tube 38' is shown to have a single layer of non-woven fiber which has been indicated to be rather densely deposited. Filter tube 38' could not have a depth loading because of the high solidity single layering, and, therefore, is a surface loading filter tube.

Figure 5:
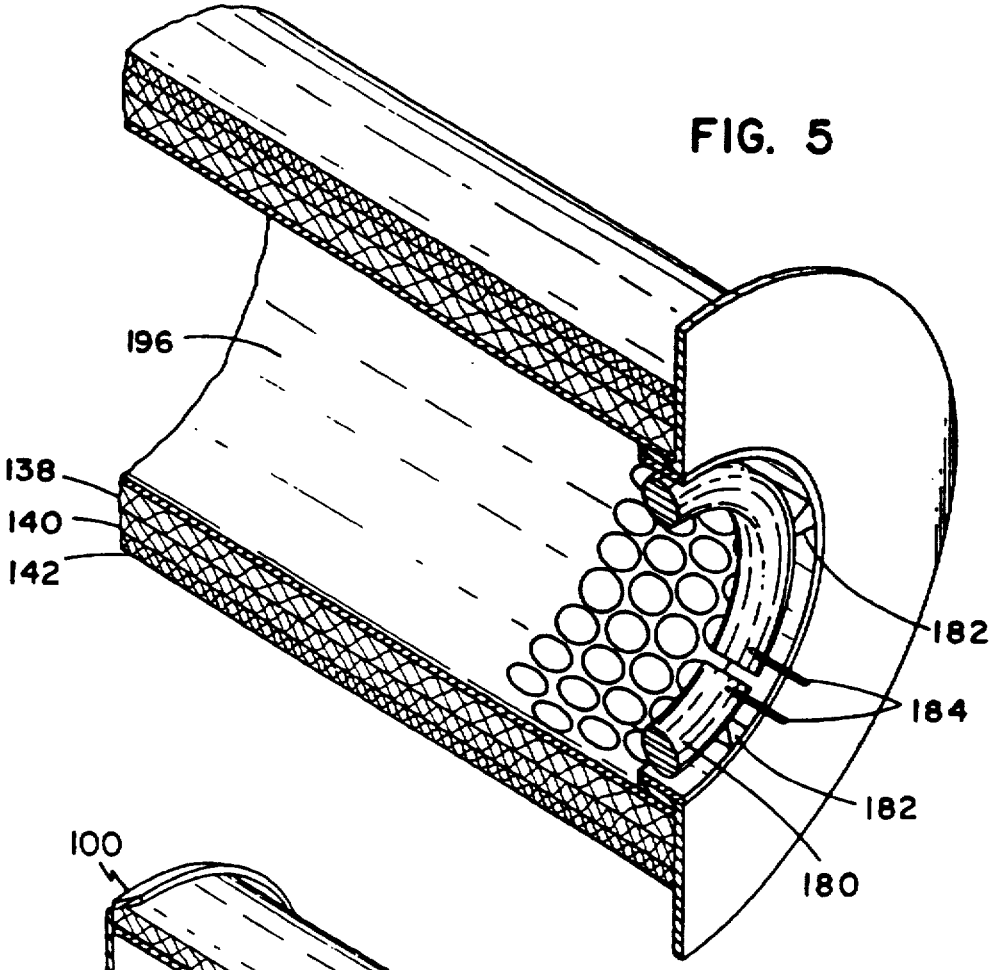
FIG. 5 is a partially cut-away perspective view of an alternate embodiment filter tube to that shown in FIG. 3.

A more uniform depth gathering of particulates is achieved when the filter tube is formed from a plurality of layers of non-woven fiber having different diameters or by varying the solidity of the fiber layers having the same diameters. As shown in FIG. 5, an innermost layer 138 of non-woven fiber has the lowest solidity and is adjacent to the perforated tube or other similar structure. Succeeding layers 140 and 142 of fiber have smaller and smaller spaces between fibers, i.e., larger and larger volume solidities. Since the lower solidity layer has larger inter-fiber spaces than the higher solidity layers, openings or pore sizes between successive layers of the non-woven fibers tend to be greater for the lower solidity layers than for the high solidity layers. Thus, some particulates can flow past the low solidity layer 138, but if not stopped by the next layer, are likely to be stopped by the layer of fiber with the highest solidity. Thus, the particulate cake accumulates less on the surface near the perforated tube and more throughout the body of the various layers of fiber of the filter tube with this type of design. It is clear that surface loading is achieved by reversing the volume solidity gradient.

Figure 6:
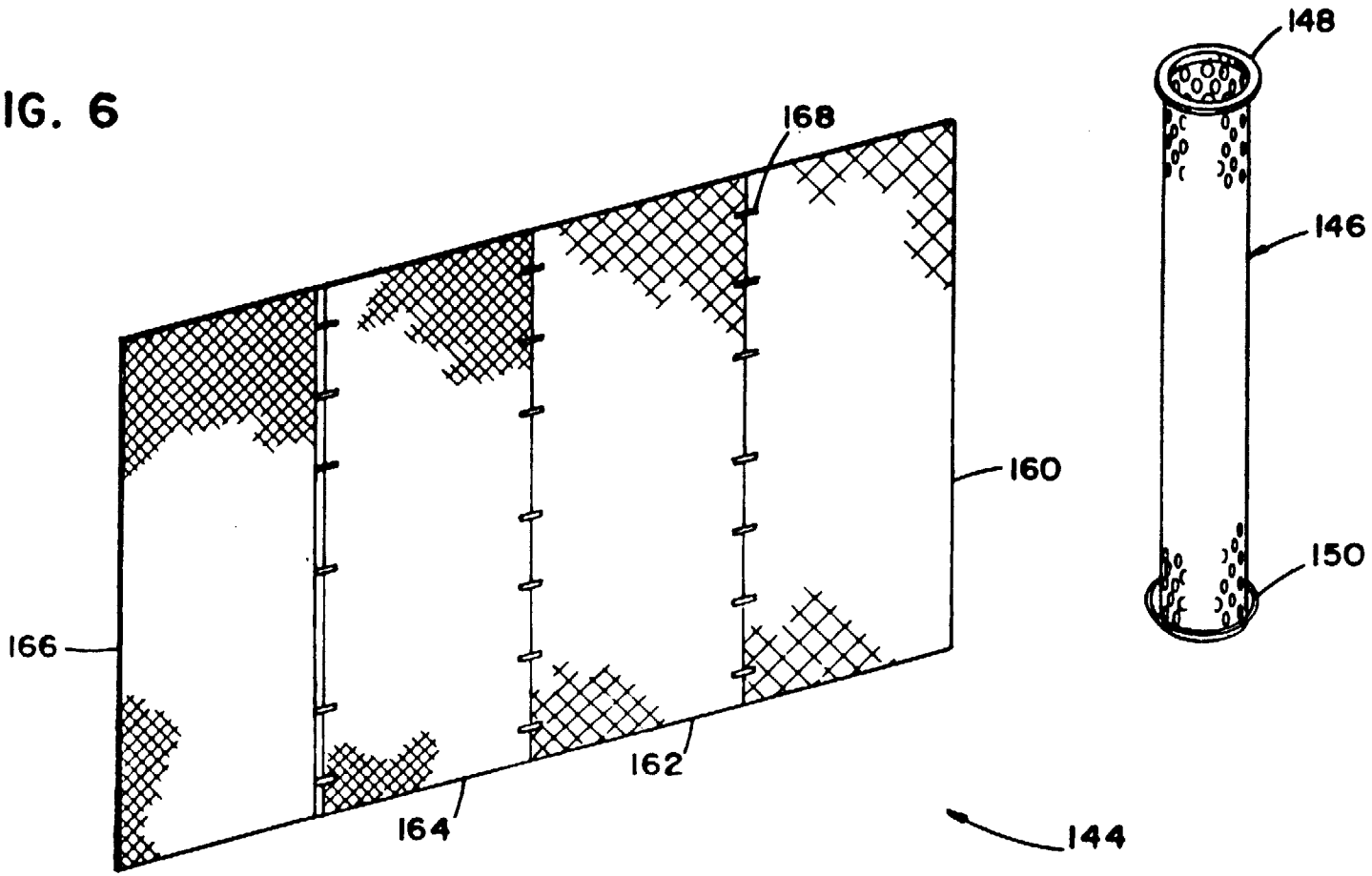
FIG. 6 is an exploded perspective view of a filter tube assembled with wrapped fiber mat.

A preferred filter tube 144 for depth loading of particulates is illustrated in FIG. 6. Filter tube 144 is formed by wrapping a plurality of connected non-woven mats of fiber about a perforated tube. More particularly, filter tube 144 includes a perforated tube 146 having a flat retaining wall 148 at one end and a cupped retaining wall with a closure wall 150 at the other end as described adequately hereinbefore. A layer of non-woven mat 160 having the lowest volume solidity is wrapped closest to perforated tube 146. The next layer 162 has a higher volume solidity, while layers 164 and 166 after that have still higher solidities. The various non-woven mats of different solidities are held together by staples or other equivalent coupling mechanism 168. When the non-woven mats as coupled together are wrapped onto the perforated tube 146, at least one complete layer of each solidity should cover the entire circumference about the tube.

As indicated previously, with lower solidity layers upstream and higher solidity layers downstream, a filter tube achieves a depth loading of particulates. A metal mesh heater located upstream of the layers of non-woven matting, provides rapid heating of the captured particulates and a complete regeneration of the filter tube from one end to the other with a rapid combustion of the depth loading. The various non-woven solidities of the matting provide a gradient structure which preferably results in a rather uniform loading of particulates. This gives the unique behavior of low overall exothermic heat release in any given area of the filter tube. The entire mass of the filter tube is used to absorb the energy liberated by the regeneration process with the result being that the filter tube can advantageously load over a wider range of mass while yet being regenerated at comparatively decreased peak temperatures.

Another significant advantage of filter tube 144 is that the depth loading is achieved at a comparatively lower pressure differential across the filter tube for a given mass collected. A system, therefore, using this type of filter tube in general allows the engine to function with a decreased back pressure from the exhaust system and function thus more efficiently overall.

Ceramic fiber yarn and such yarn woven into a matting is commercialized under the NEXTEL trademark by 3M Company, St. Paul, Minn. Other appropriate yarn, fibrous matting, and foam materials are likewise available commercially.

Heating Element Embodiments

As indicated earlier, filter tubes develop a particulate cake such that the pressure drop across them increases and can begin to affect engine performance. Consequently, filter tubes must be periodically cleaned or regenerated. Regeneration occurs when the particulates are heated sufficiently to ignite and burn. Heating in accordance with the present invention may occur predominately at one end of the filter tube or may occur over the entire longitudinal length of the filter tube.

When a heater causes ignition of particulates at one end of a filter tube, the particulate cake burns from one end to the other by what can be called axial propagation. As shown in FIG. 3, filter tube 38 has a ring-type heating element 174 in accordance with the present invention. That is, relative to the longitudinal axis of the cylindrical perforated tube 96, heating element 174 is centered generally on a radial plane and initially ignites particulates relative thereto. Heating element 174 is spaced from perforated tube 96 by an insulating ring 176. Ring 176 is appropriately attached to perforated tube 96 while heating element ring 174 is appropriately attached to insulating ring 176. Heating element 174 has a pair of electrodes 178 which are connected as known by those skilled in the art via line 124 to processer 116. (See also FIG. 1.)

Alternatively, as shown in FIG. 5, rather than the cross-sectional rectangular shape of the ring of 174, heating element 180 has a circular rod cross-sectional shape and is spaced from perforated tube 196 by a plurality of insulating brackets 182. Heating element 180 has a pair of electrodes 184.

Although the filter tube of FIG. 5 has a volume solidity gradient which would tend to allow particulates to load throughout the body of the filter, rather than preferentially along the surface, as has been discussed adequately, the volume solidity gradient could be reversed and surface loading achieved. In any case, unless the particulate cake is periodically burned so that the filter is regenerated, exhaust gas pressure will increase and start to affect engine operation. Advantageously, it has been observed that a regenerative particulate burning flame propagates axially along, in the best case, a surface load of a filter tube. This regenerative characteristic exists when the exotherm of the combustion reaction in one location is sufficient to heat and combust an axially adjacent section of particulate loading on the filter tube. Recognizing this, allows a combustion starting heater to be located at one end of the tube, such as heating elements 174 and 180, and ignite the particulate cake at that end and allow the regeneration process to progress axially down the length of the tube.

Since a localized heater, such as ring heater 174, can be small compared to the entire filter tube, the power requirement for regeneration of such filter tube is comparatively small also. Filter tube 38 with a heating element ring 174, thus, results in power consumption levels which are acceptable to vehicles having power systems of only 12 volts. Furthermore, no special alternator upgrades are needed.

Ring heating element 180 may require a little more power since greater amounts of heat transfer must be by radiation. Nevertheless, the radiation is contained within the interior of the perforated tube and power consumption should also be relatively small to accomplish regeneration by axial propagation.

As indicated, regeneration may also occur efficiently by heating a filter tube from its interior along its entire length. In such situation, all the radiation from the heating element is absorbed by some part of the interior so that there is no backscatter loss. The embodiment of FIG. 7 is exemplary.

Filter tube 186 has a central perforated tube 188, preferably made from stainless steel. An upstream end member 190 has a circular groove for receiving one end of perforated tube 188. End member 190 includes a flange portion 192 for contacting plate 90 (see FIG. 2). End member 190 is an electrical insulator and, includes a central opening 194 for receiving axially extending rod heater 196, and a plurality of inlet openings 198 for receiving pre-filtered exhaust gases.

Downstream end member 200 has a closure portion 202 and an electrode portion 204. Closure portion 202 is made from an electrically insulating material and is flat, except for a central opening 206 through which rod heater 196 passes and a sleeve portion 208 encircling opening 206 and extending into electrode portion 204. The outer edge 210 of closure portion 202 is inclined or shaped as appropriate to be received by perforated plate 92 (see FIG. 4). Closure portion 202 also has a circular groove for receiving the downstream end of perforated tube 188.

Electrode portion 204 has a threaded electrode end 212 and a receiving end 214 for receiving an end of rod heater 196. Receiving end 214 includes a cavity 216 for the end of rod heater 196, with receiving cavity 216 having an enlarged entrance portion 218 for receiving sleeve 208. Closure portion 202 and electrode portion 204 are fastened together by threading or other acceptable fastening mechanism. Similarly, perforated tube 188 is fastened in the grooves of upstream and downstream end members 190 and 200 as appropriate. Fiber yarn or mat 220 may be wound or wrapped about perforated tube 188 as adequately described hereinbefore.

Figure 23:
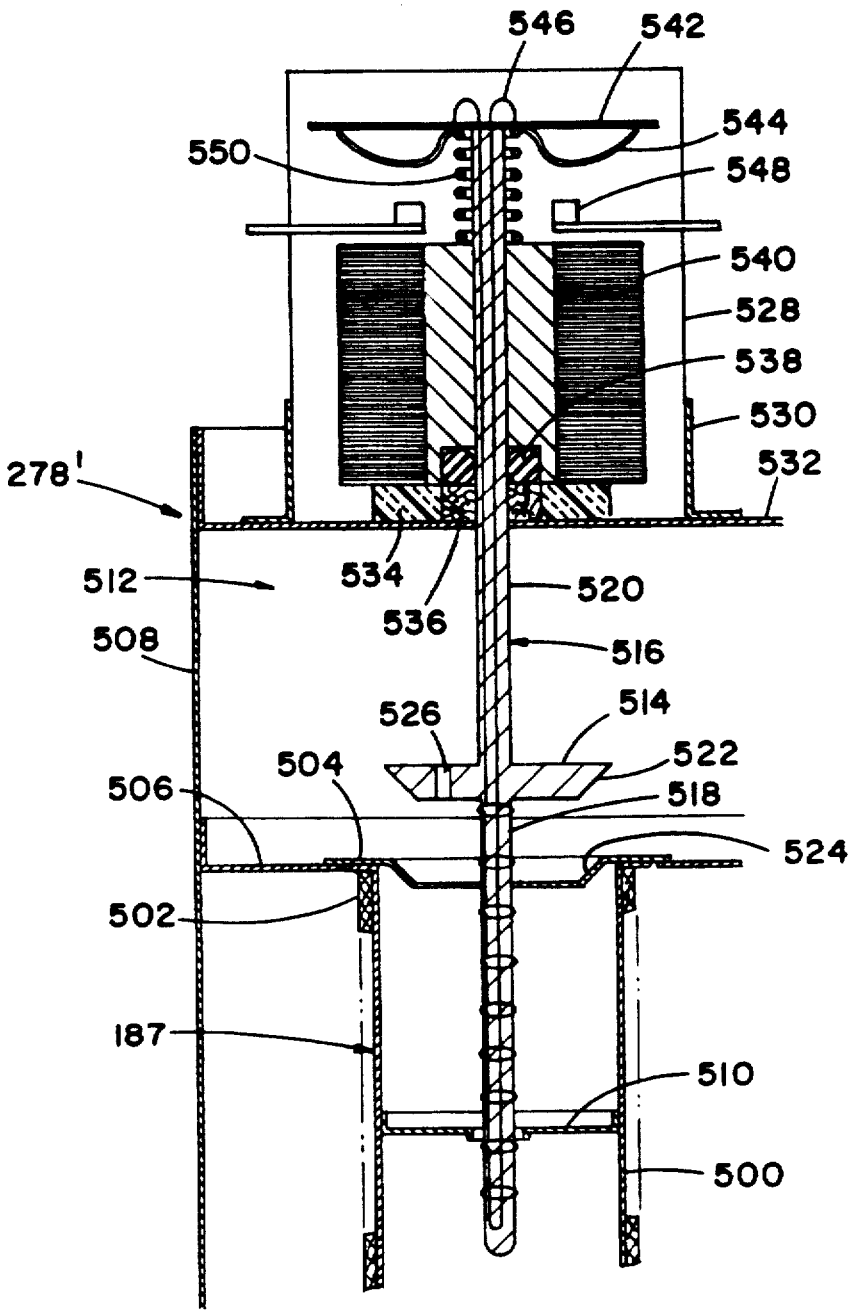
FIG. 23 is a cross-sectional view of a portion of muffler-filter apparatus showing a filter tube, heating element, and electrical contact mechanism for controlling the heating element.

It is noted in passing that a shortened rod heater as shown in FIG. 23 can also be used for axial propagation regeneration as opposed to full length regeneration. This will be discussed in more detail hereinafter.

Rod heater elements (including perforated or non-perforated tubular heaters) which are intended to be spaced from the filter material may be obtained from Vulcan Electric Co., Kezar Falls, Me. 04047.

The axially extending rod heater is particularly advantageous in that the body mass of lightened supporting perforated tube 188 plus the filter material 220 thereon can be reduced compared to filter tubes which use the supporting perforated tube as the heater or otherwise bury the heater in the filter material. In addition, power consumption when using an axially extending rod heater is reasonable and obtainable from vehicular power without unreasonable upgrading of alternator and battery equipment, as observed from the following:

| | Set-Up 1 | Set-Up 2 | Set-Up 3 |
|---|---|---|---|
| Volts | 12 | 24 | 72 |
| Amps | 125 | 63 | 21 |
| Watts | 1.5 kw | 1.5 kw | 1.5 kw |
| Length | 20 in. | 20 in. | 20 in. |
| On-Time | 2-7 min. | 2-7 min. | 2-7 min. |

Furthermore, although in some embodiments it may be desirable for the rod to bear a structural load, in the present case, the durability of rod heater 196 is comparatively enhanced because the heater need not bear any structural load. As indicated, filter tube filters which try to use a mesh or perforated tube as both the structure and the heater for ceramic fiber are too flimsy. When subjected to evaluated temperatures and vehicle vibration, the filter has a tendency to buckle or deform and not regenerate effectively. Filter tube 186 overcomes these problems in that the perforated tube is made of stainless steel and provides a rigid structure for the ceramic fiber, while the rod heater provides sufficient heat without power system enhancements.

Figure 9:
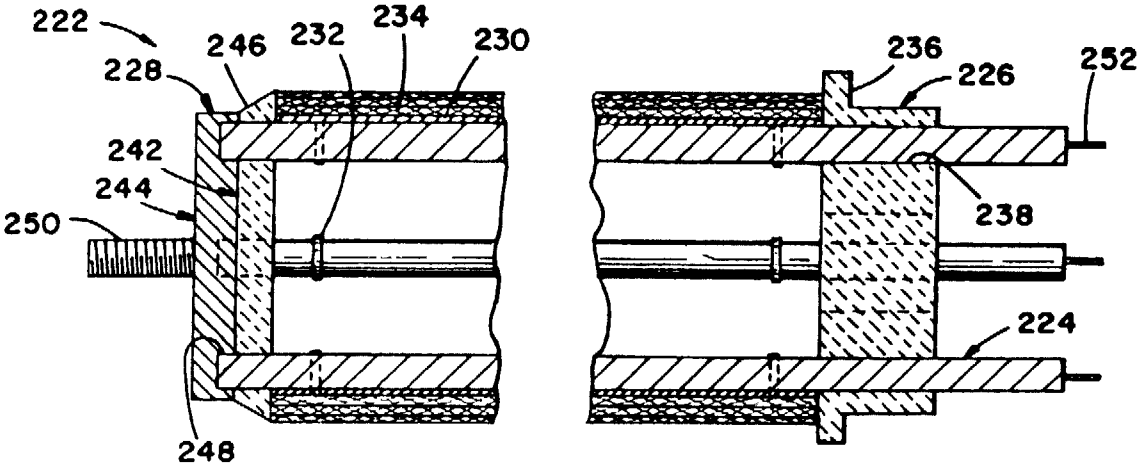
FIG. 9 is a cross-sectional view taken along line 9—9 of FIG. 8.
Figure 8:
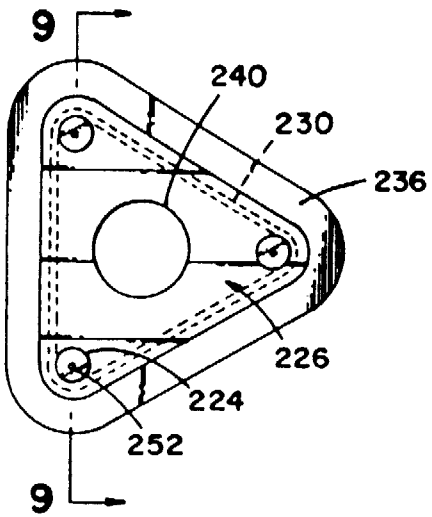
FIG. 8 is an end view of a filter tube which uses three rod heaters as structural support.

Alternatively, the heating/structural problem can also be overcome by using a plurality of rod heaters and using them structurally. Then, a structural perforated tube is not needed and rather a more flimsy wire mesh can be used between end members. With reference to FIGS. 8 and 9, filter tube 222 includes three rod heaters 224 held in a triangular relationship by upstream end member 226 and downstream end member 228. Wire mesh 230 is wrapped about the three heating elements 224 and held in place by tie members 232. Ceramic fiber yarn or mat 234 is wrapped about wire mesh 230.

Upstream end member 226 has a flange portion 236 which serves as a retainer for the ceramic fiber and also provides a contact surface against plate 90 when filter tube 222 is inserted into a housing like that in FIG. 2. Upstream end member 226 is made of an insulating material. It includes openings 238 for receiving heating elements 224. It further includes an opening 240 to allow passage of exhaust gases into the interior of filter tube 222.

Downstream end member 228 includes an insulating portion 242 and a conductive electrode portion 244. Insulating portion 242 has openings through which heating elements 224 pass. Insulating portion 242 also has an inclined edge 246 for fitting perforated plate 92, as appropriate. Electrode portion 244 has cavities 248 for receiving the ends of heating elements 224. A threaded stud 250 extends outwardly for appropriate connection to a power source. Central wires 252 at the upstream end of heating elements 224 provides the other power contact.

Figure 10:
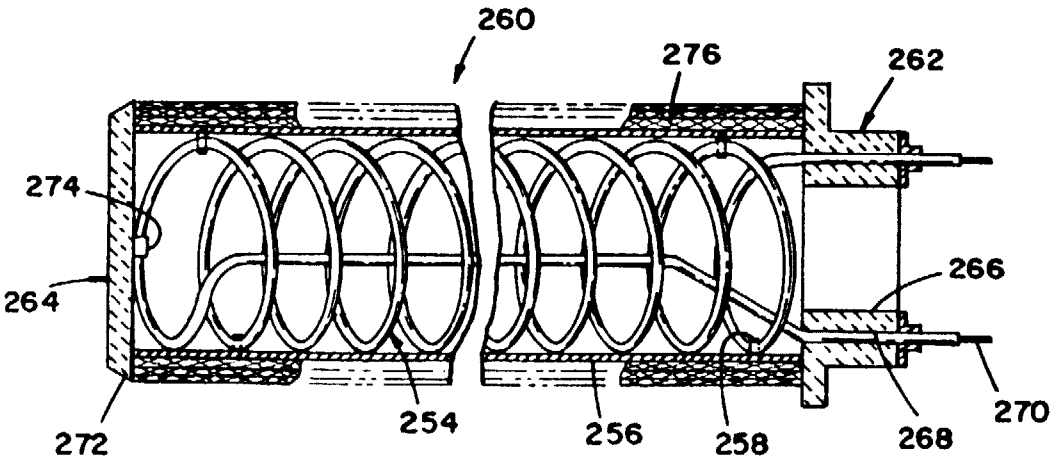
FIG. 10 is a cross-sectional view of a filter tube having a spiral heating element which is used as structural support.

It is not necessary for the heating elements to be rods. As shown in FIG. 10, heating element 254 is formed as a spiral with a wire mesh 256 attached with coupling ties 258 to the heating element at appropriate locations. It is understood that other shapes could as well be formed. Filter tube 260 as is usual includes an upstream end member 262 and a downstream end member 264. Both end members are made of an insulating material. Upstream end member 262 has a central opening 266 for passing exhaust gases. Upstream end member 262 also includes a pair of passages 268 for receiving therethrough the ends 270 of the heating element 254. Downstream end member 264 is a solid plate with an inclined edge 272 or other appropriate shape to fit perforated plate 92, if necessary. Heating element 254 is retained at downstream end member 264 with a retainer bracket 274 which is attached with a screw or other fastening mechanism to end member 264. Ceramic fiber yarn or mat 276 is wound around wire mesh 256 and supported thereon as well as by spiral heating element 254.

As alluded to hereinbefore, a further filter tube and heating element alternative which is sort of a hybrid of the concepts just discussed is shown in FIG. 23. Filter tube 187 has a surface loading filter material configuration and rod-type heating element 518. Although the rod has a length which is significant relative to the total length of filter tube 187, it does not extend the entire length and rather relies on igniting particulates near the one end so that they may burn by axial propagation to regenerate the entire filter tube. It is noted that surface loading is desirable for axial propagation regeneration. In this way, filter tube 187 realizes many of the advantages of both the axial propagation ring-type regeneration systems and the longitudinal igniting full rod-type systems. Although other forms of ceramic fiber filter material may also be used, it is noted that the ceramic fiber mat 502 on filter tube 187 is of the non-woven, random array type.

Poppet Valve Embodiments

As discussed with respect to muffler-filter apparatus 30 in FIG. 1, a poppet valve 128 is driven by a solenoid 130 and controlled by the processing device 116. The valve, at appropriate times, opens and closes fluid communication of exhaust gases to a given quadrant of filter tubes 38. When fluid communication is open, the filter tubes are available for filtering particulates from the exhaust gases. When fluid communication is closed, the filter tubes are available for regeneration. Regeneration is accomplished when heating element 122 heats sufficiently to ignite the accumulated particulates. Alternate embodiment heating elements have been hereinbefore discussed.

Figure 11:
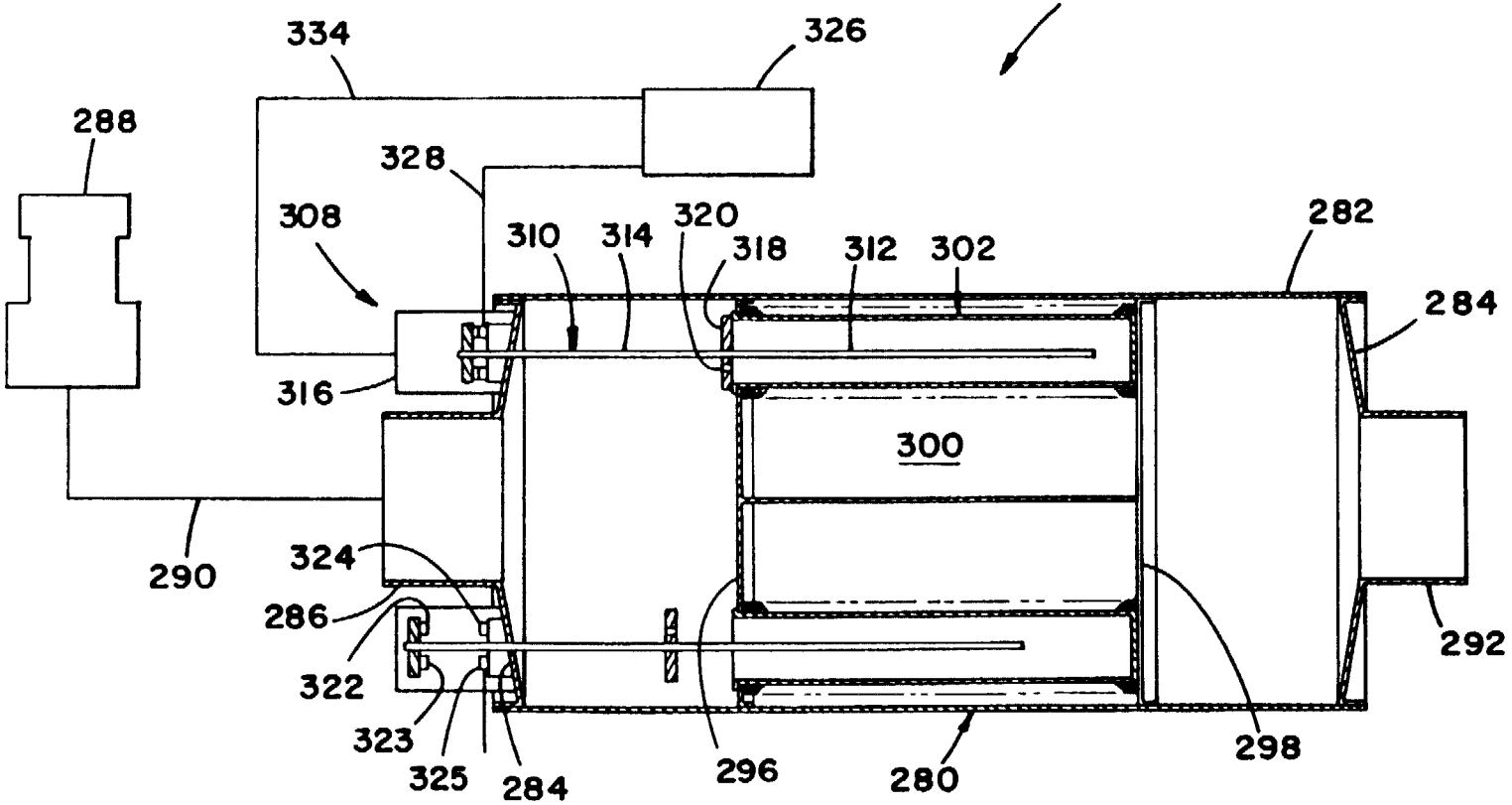
FIG. 11 illustrates an alternate embodiment exhaust system including a cross-sectional view of muffler-filter apparatus.

Alternatively, as shown in FIG. 11, the valving and heating functions can be combined. Apparatus 278 includes a housing 280 comprising a cylindrical wall 282 with opposite end walls 284. An inlet pipe 286 extends from one of the end walls and is in fluid communication with engine 288 via line 290. An outlet pipe 292 extends from the other end wall. Upstream and downstream walls 296 and 298 are provided to support filter tubes 302. Upstream wall 296, which is similar to end wall 90 discussed hereinbefore, functions to provide adequate provision for the valving function. End wall 298 is perforated to allow easy flow of filtered exhaust gases. A plurality of impermeable walls 300 extend between upstream and downstream walls 296 and 298 and separate the various filter tubes 302.

Valve assembly 308 provides both the valving and regenerative heating functions for filter tube 302. Valve assembly 308 has a valve member 310 which includes a rod heater portion 312. A non-heating rod portion 314 extends from the upstream end of the filter tube 302 when the valve is closed through end wall 284 so as to function appropriately with solenoid 316. A valve head 318 extends transversely from rod member 310 in the region between the heating and non-heating portions 312 and 314. Valve head 318 and the upstream end of filter tube 302 seat with one another sufficiently when there is closure to divert the exhaust gases to other filter tubes and allow filter tube 302 to be regenerated. An opening 320 in head 316 provides sufficient leakage of exhaust gases and combustion oxygen not previously oxidized. Within or in conjunction with the housing of solenoid 316, valve member 310 further includes contact elements 322 and 323 which, when solenoid 318 causes valve head 316 to close against the filter tube end, contact elements 322 and 323 move against fixed contact members 324 and 325 to energize rod heating portion 312. Fixed contacts 324 and 325 are connected to processor 326 via line 328.

Solenoid 316 is in electrical communication via line 334 with processor 326. Control of solenoid 316 to accomplish both the valving and heating functions via processor 326 can be by a simple timer which times the amount of filtration time for a particular filter tube. Also, control mechanisms which are more complicated such as the differential pressure system disclosed with reference to FIG. 1 could be used.

Apparatus 278' in FIG. 23 shows, in more detail, a valving and heating assembly similar to that of FIG. 11. Filter tube 187 includes a perforated tube 500 with a non-woven, random array ceramic fiber mat 502. Upstream end member 504 is attached to or is formed as a part of perforated tube 500. End member 504 includes a flange member extending outwardly to contact solid plate 506 which is attached to wall 508 of the housing. A guide member 510 in the form of a spider is attached to the inside of perforated tube 500 for the purpose of guiding the lower end of valve member 512. Valve member 512 has a valve head 514 which proximately separates the valve stem 516 so that a heated portion 518 is downstream from it and an unheated portion 520 is upstream from it. Valve head 514 has a beveled edge 522 to fit snugly with valve seat 524 of end member 504. An opening 526 extends through valve head 522 to provide leakage of exhaust gases, including some oxygen, during regeneration.

Valve housing 528 is fastened with bracket 530 to end 532 of the muffler-filter housing. Housing 528 is insulated with insulation 534 from the hot end 532. A dynamic seal 536 is installed about valve stem 516 and between end 532 and an 0-ring packing 538. The dynamic seal provides a sealing for the moveable valve stem 516. The 0-ring packing 538 provides a seal for solenoid housing 528. Solenoid 540 is appropriately installed as known by those skilled in the art within housing 528. A support plate 542 is attached to the end of valve stem 516 and supports a pair of contact springs 544. Contact springs 544 are in continuity with opposite ends of resistance wire 546. Resistance wire 546 is coiled so as to create substantial heat in the heated portion 518 of valve stem 516. In the non-heated portion 520, the resistance wire is not coiled and that portion of the stem remains relatively cool. Fixed contacts 548 are located near the end of solenoid 540 and face spring contacts 544. The fixed contacts are in electrical continuity with the control processor (not shown). A spring 550 between support plate 542 and the facing end of solenoid 540 keeps the contacts separated when solenoid pipe 540 is de-energized so that valve 512 is open. Thus, when solenoid 540 is energized, valve 512 closes and the heating portion 518 heats so that regeneration can occur. Heating portion 518 is substantially shorter than the rod heater 312 in FIG. 11 and so regeneration is intended to occur by axial propagation as discussed adequately hereinbefore. When solenoid 540 is de-energized, spring 550 moves valve stem 516 to open the valve space and also open the circuit between the contacts.

It is noted that assembly 278' provides a filter tube and heating element alternative which is sort of a hybrid of several concepts previously discussed. Since the assembly has a rod heater but depends on axial propagation to regenerate, filter tube 187 realizes many of the advantages of both the axial propagation ring-type regeneration systems and the longitudinal igniting full rod-type systems.

Figure 12:
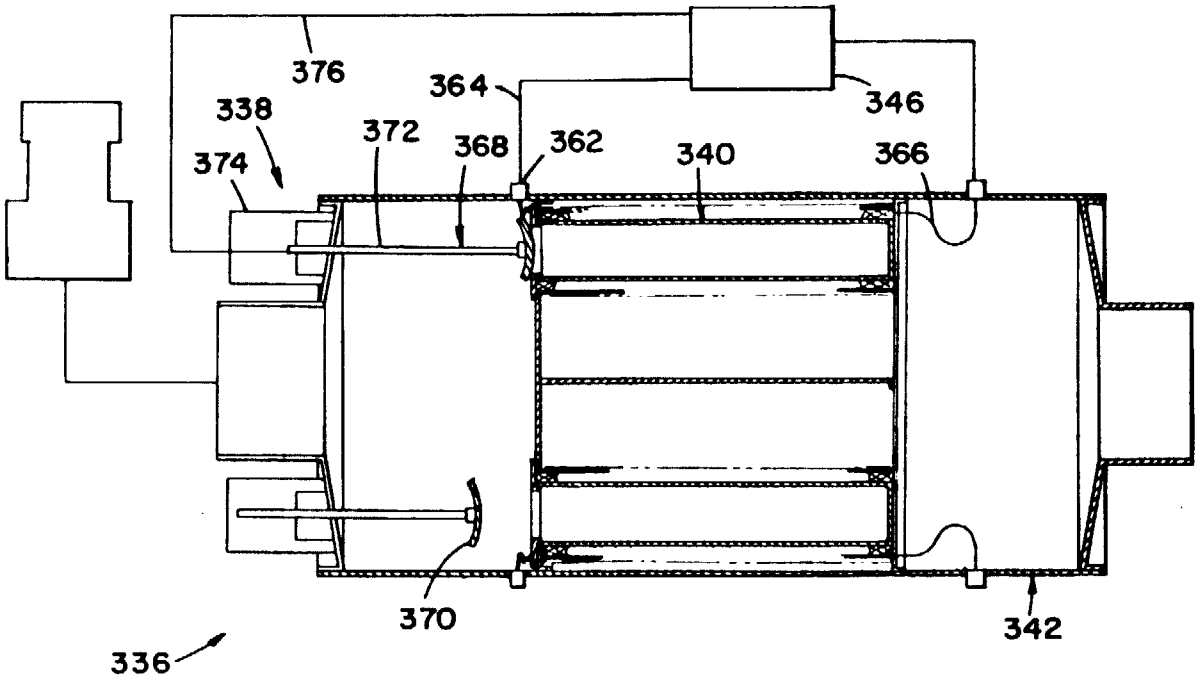
FIG. 12 illustrates another alternate embodiment exhaust system including a cross-sectional view of muffler-filter apparatus.

Muffler-filter apparatus 336 as shown in FIG. 12 shows another alternate embodiment valve assembly 338. When valve assembly 338 closes and opens, it also provides a simple mechanical mechanism for closing and opening electrical continuity with respect to providing power to the heating element of filter tube 340.

Figure 13:
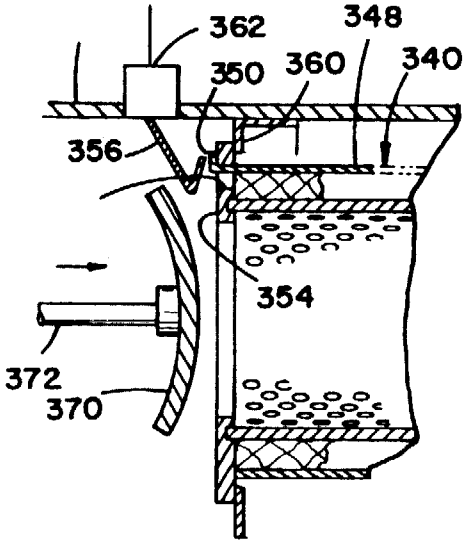
FIG. 13 is an enlarged view of a valve portion of FIG. 12.

Apparatus 336 includes a first housing 342 similar to first housing 280 in FIG. 11 and structure for supporting filter tubes similar to FIG. 11. Processor 346 is also similar to processor 326. Although any of the various filter tubes disclosed herein could be used with the present embodiment, a filter tube 340 is shown to be similar to filter tube 144 of FIG. 6. In that regard, as shown in FIG. 13, an upstream wire end 348 of a mesh heater is bent to form a contact surface 350 at the location where it extends out slot 352 from upstream end retaining wall 354. A spring-like wire 356 is supported from upstream end wall 360. Wire 356 is in electrical continuity through connector 362 in housing 342 with processor 346 via line 364. The downstream end of wire mesh heater 348 is in electrical continuity with processor 346 via line 366.

Valve assembly 338 has a valve member 368 with valve head 370 and valve stem 372. The valve is driven by solenoid 374 controlled via line 376 by processor 346. Valve head 370 is somewhat flexible so that as it moves toward closure of filter tube 340, it not only closes the entrance opening to filter tube 340, but also contacts spring-like wire 356 and bends it into contact with the contact surface 350 of wire 348 of the wire mesh heater for filter tube 340. Thus, when valve assembly 338 closes, the wire mesh heater of filter tube 340 is also turned on. When valve assembly 338 opens, spring-like wire 356 springs away from contact with contact surface 350 and breaks electrical continuity to turn the heating off.

Several filter tube embodiments have been discussed wherein filter material is used in different ways to provide a mechanism for filtering particulates from exhaust gases of an engine, primarily a diesel engine. Perforated tubes and wire mesh have been indicated as mechanisms for supporting fiber and provide a predetermined shape relative to the central axis of the filter tube. More substantial structure for maintaining the supporting mechanism in the predetermined shape has been indicated, particularly with respect to FIGS. 9 and 10. In those embodiments, the heating elements provided the necessary structure, while a wire mesh provided a supporting mechanism for the ceramic fiber.

Figure 26:
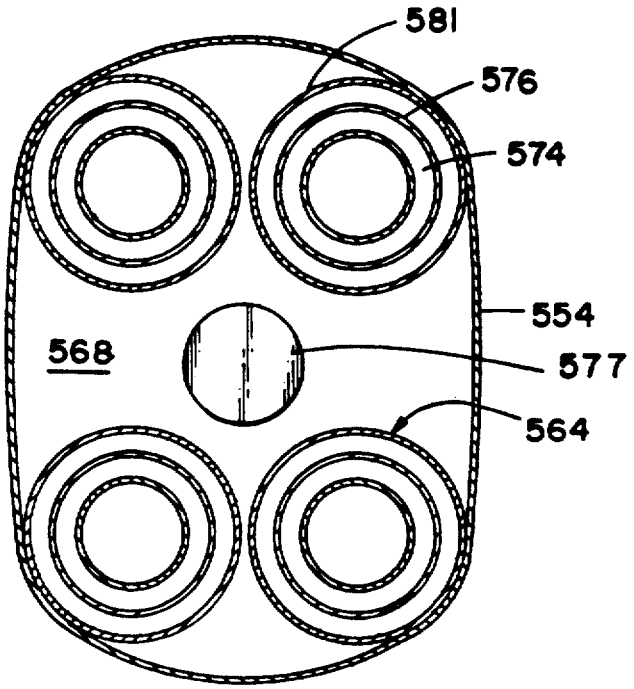
FIG. 26 is a cross-sectional view taken along line 26—26 of FIG. 25.
Figure 25:
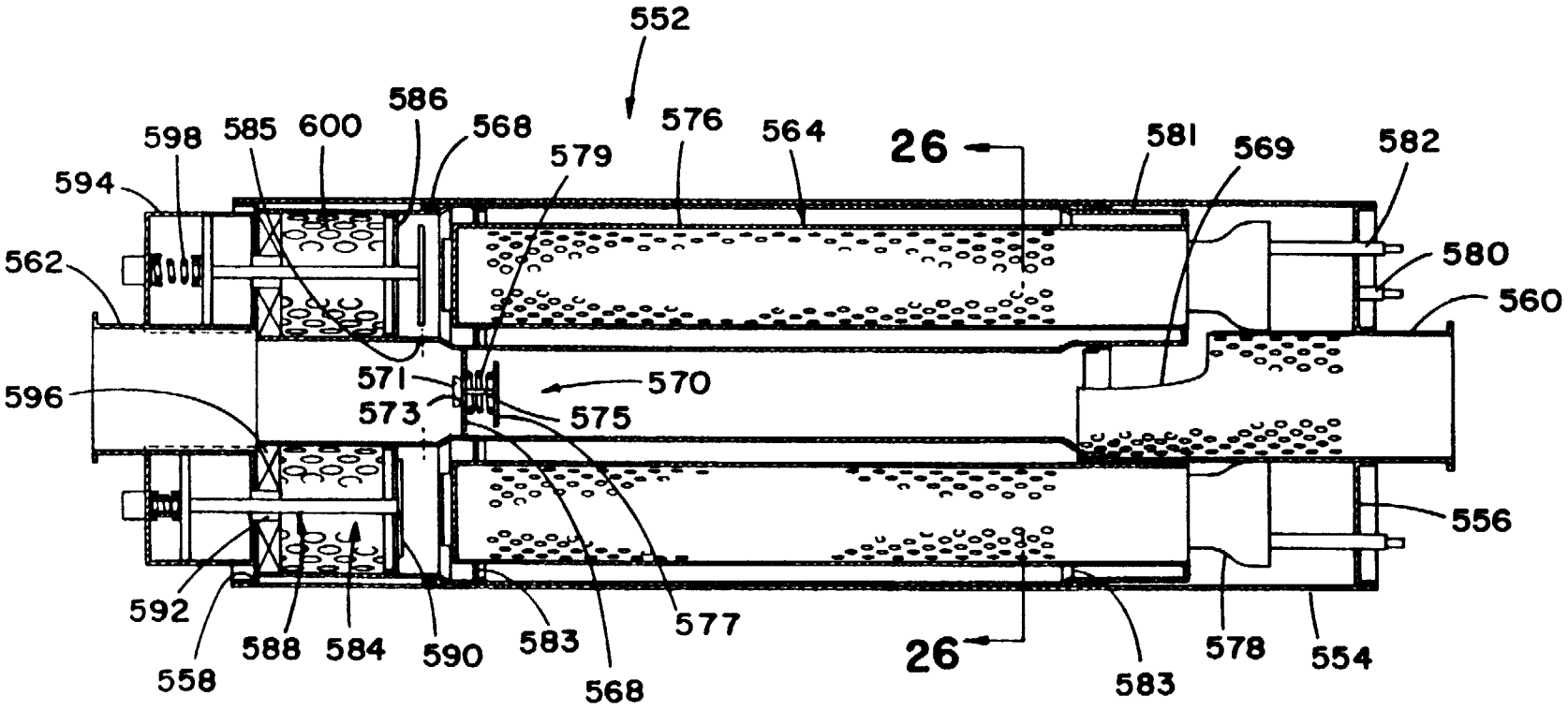
FIG. 25 illustrates another alternate embodiment exhaust system including a cross-sectional view of muffler-filter apparatus with structural support surrounding the filter material and a valve downstream of the filter material.

A further alternative is shown in FIGS. 25 and 26. Muffler-filter apparatus 552 includes a housing 555 comprising an elongated curved wall 554 with opposite end walls 556 and 558. An inlet tube 560 extends at a central location through wall 556. An outlet tube 562 extends at a central location through wall 558. Four filter tube modules 564 are installed within housing wall 554 in a symmetrical arrangement as shown in FIG. 26. Modules 564 are supported at opposite ends by support plates 566 and 568. Support plate 566 not only holds the filter modules, but also supports the downstream end of inlet pipe 560. In this regard, inlet pipe 560 has a choke 569 at the outlet end and perforations between the outlet end and wall 556. In that way, exhaust gases are forced from the perforations and through the filter modules, as support plate 568 prevents further downstream flow except through the filter modules. A relief valve 570, although not necessary, is preferably installed centrally in support plate 568. Relief valve 570 includes a valve head 571 matched with the seat 573 in support plate 568.

Filter module 564 can include a low mass, perforated filter tube (not shown) with, for example, fiber yarn, woven mat, or random array, non-woven mat 574 wrapped thereabout. The structural support for the filter tube is provided by a perforated tubular member 576 which closely surrounds fiber 574. Containing tubes 581 are generally cylindrical and extend from a position adjacent to the side wall of inlet pipe 560 to the end wall 558. Perforated tubular member 576 is supported relative to containing tube 581 by spider-like bracket members 583 near opposite ends of the perforated tubular members. An inlet nozzle 578 is fastened to each containing tube at the inlet end. The inlet nozzle has a pressure drop purpose not otherwise important to the present invention. A heater (not shown) is installed at the inlet ends of modules 564 in accordance with any embodiments appropriate of types discussed hereinbefore. Ground and power electrodes 580 and 582 are shown. Perforated support tube (not shown) is closed at the downstream end so that exhaust gases must flow from inside out through the filter tube. A poppet valve assembly 584 is installed in each of the filter tube modules at the downstream ends. Poppet valve assembly 584 includes a seat member 586 spaced from the downstream end of filter module 564. A valve member 588 has a head 590 for movement relative to seat member 586 in the region between seat member 586 and the downstream end of filter tube module 564. Valve stem 590 extends through a dynamic seal 592 and end wall 558 into a housing 594. Seal 592 is supported inside end 558 by an insulation member 596. Insulation member 596 prevents excessive heat from passing through to housing 594. Valve member 588 is appropriately adapted to fit within housing 594 to be driven to open and closed positions by spring 598 and air pressure from a source not shown. A small opening 585 is formed in the wall of containing tube 581 between valve seat member 586 and support plate 568. When valve assembly 584 is closed, the presence of opening 585 allows for a slow flow of exhaust gases through the module so that the exhaust gases do not completely stagnate, but rather provide some oxygen to maintain the regeneration combustion until the particulates are all burned.

In use, exhaust gases flow into inlet pipe 560 and out the perforations to the various filter tube modules for entrance at nozzles 578. Exhaust gases flow through all filter modules which are not stopped at the downstream ends by a closed valve. If the valve is closed, exhaust gases stagnate, except as indicated, within the particular filter module and make it available for regeneration by energization of the appropriate heater element. Regeneration control may be accomplished by timing or other control mechanisms as disclosed hereinbefore. Exhaust gases flow from inside the filter tube module to outside the filtering mechanism in a region between the filter material and the containing tube 581. The filtered exhaust gases flow through the open valve seat opening and out perforations 600 in tubular member 576 in the region between valve seat member 586 and insulation member 596. Exhaust gases are then free to flow out exhaust tube 562.

Muffler-filter assembly 552 is particularly advantageous in that the poppet valve assembly is located at the downstream or coolest end of the housing. Also, the filter module is constructed to have a low mass filter and support mechanism by having a surrounding external tube which provides structural strength. The low mass perforated support tube allows for rapid heating during regeneration and has little effect on the propagating combustion. The assembly also provides various sound muffling characteristics.

Other Valve Embodiments

Figure 16:
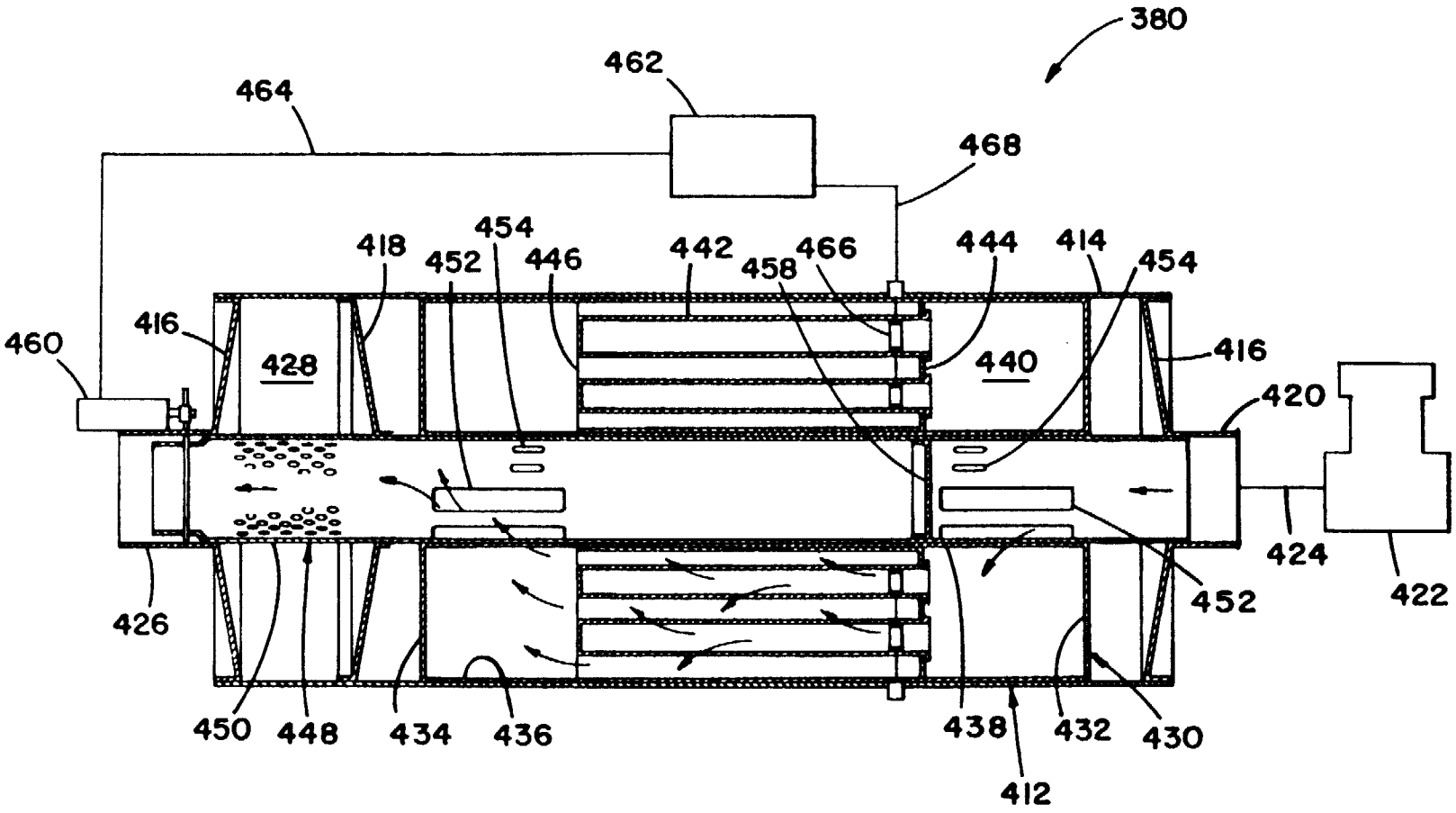
FIG. 16 is another alternate embodiment exhaust system including a cross-sectional view of muffler-filter apparatus.
Figure 18:
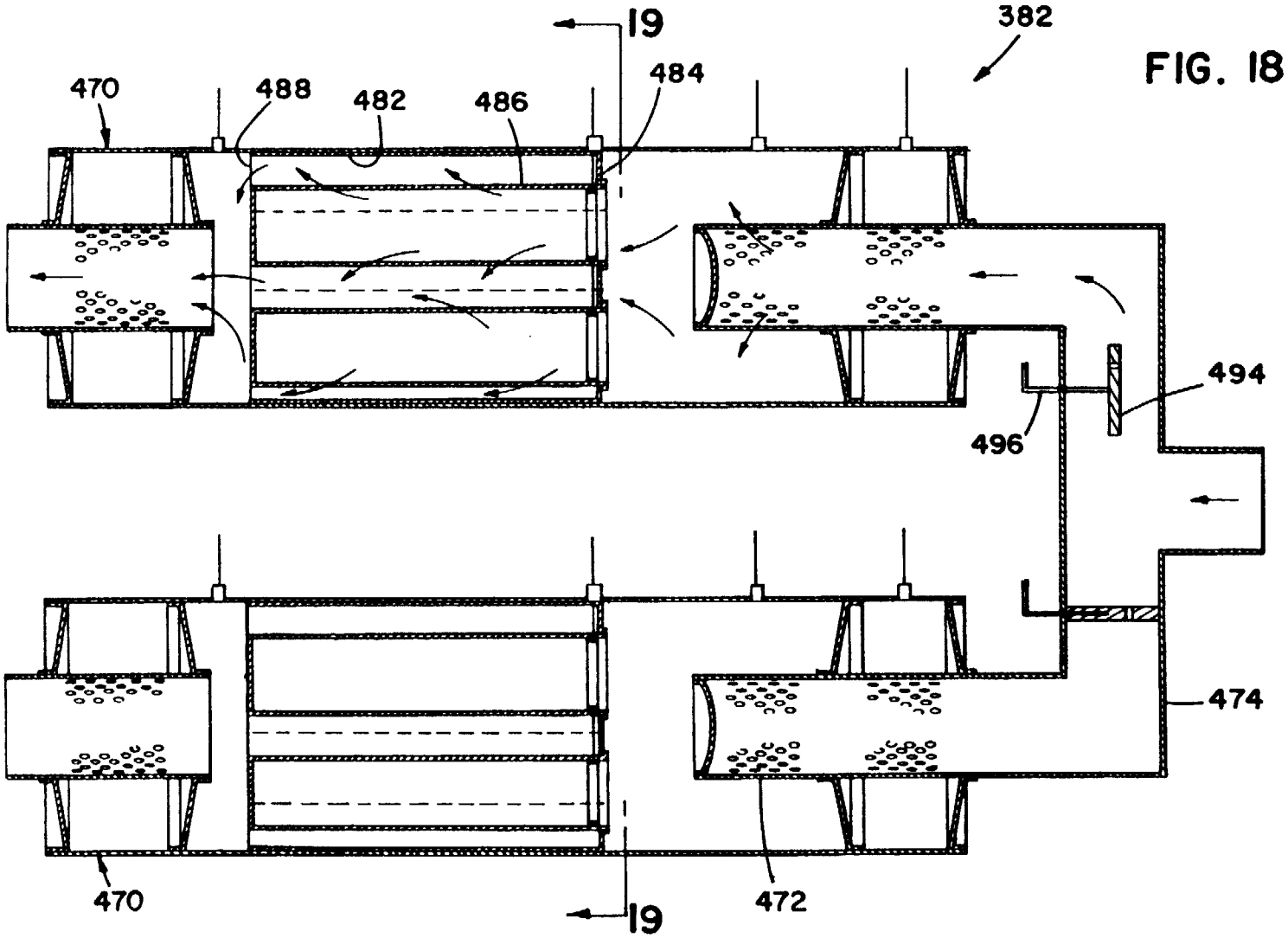
FIG. 18 illustrates an alternate embodiment exhaust system including a cross-sectional view of muffler-filter apparatus.

In the embodiments described hereinbefore, various poppet valves have been used to control the flow of exhaust gases to or away from filter tubes so that they may either filter particulates from the exhaust gases or be available for regeneration. Exhaust gas flow may be controlled as well by other valve structures. Muffler-filter apparatus 378 in FIG. 14 uses a shutter valve. Muffler-filter apparatus 380 in FIG. 16 uses a tube valve. Muffler-filter apparatus 382 in FIG. 18 uses butterfly valves in inlet tubes leading to various housings.

Figure 14:
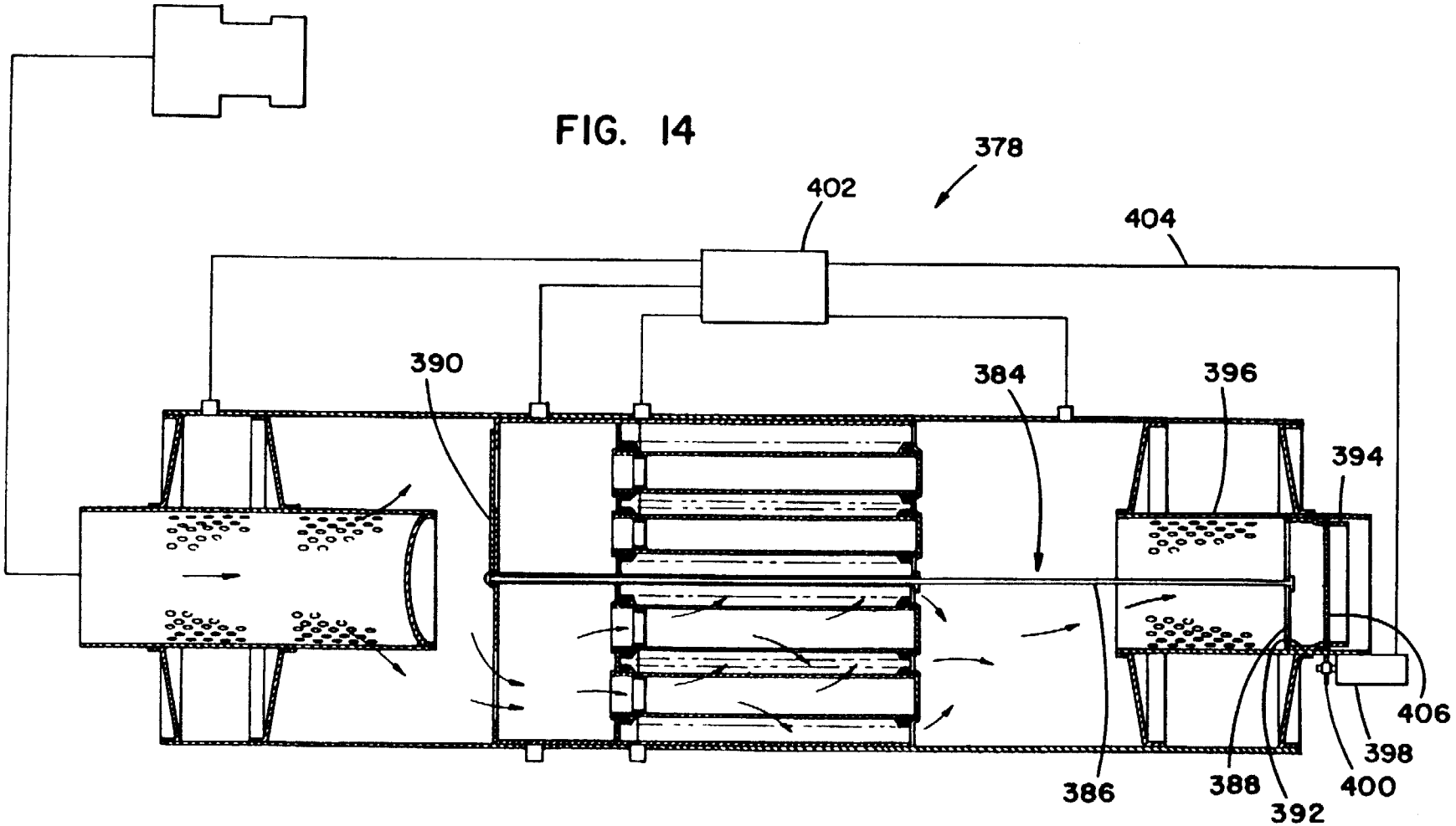
FIG. 14 is another alternate embodiment exhaust system including a cross-sectional view of muffler-filter apparatus.

Muffler-filter apparatus 378 of FIG. 14 is similar to apparatus 30 of FIG. 1 except it does not have the poppet valves 128. Rather, apparatus 378 has a shutter valve assembly 384. Shutter valve assembly 384 includes a rod 386 extending from attachment to a spider 388 to attachment with a shutter 390. Spider 388 extends transversely outwardly of rod 386. Spider 388 is attached at its periphery to a tube 392 which includes a nozzle portion 394. Tube 392 has an outer diameter only slightly less than the inner diameter of outlet pipe 396. Nozzle portion 394 is downstream from the rest of tube 392. A motor 398 with a gear 400 rotates tube 392. Motor 398 is in electrical continuity with processor 402 via line 404. Gear 400 extends through an opening in the side of outlet pipe 396 and meshes with a plurality of slots 406 in the nozzle portion of tube 392. The nozzle formation serves to aspirate air through the opening for gear 400 in outlet pipe 396 rather than allow the exhaust gases to escape from the opening.

Figure 15:
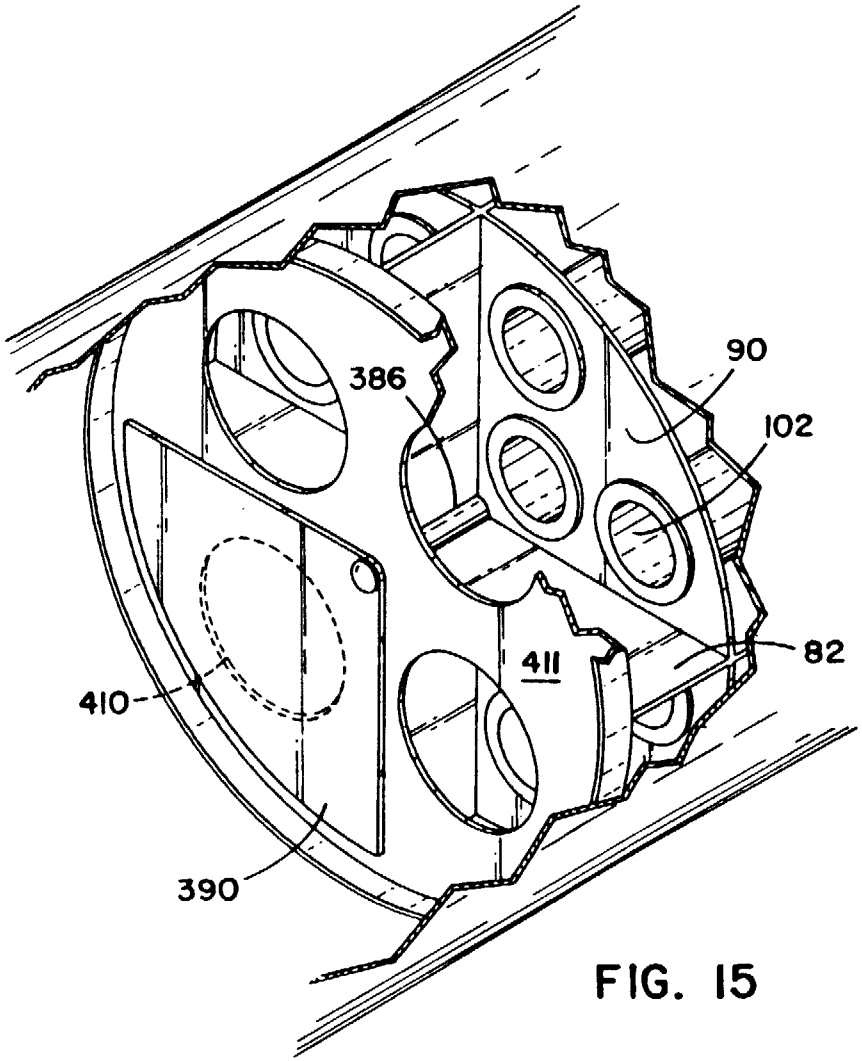
FIG. 15 is a partially cut-away perspective view of one end of a second housing as installed in the muffler-filter apparatus of FIG. 14.

With reference to FIG. 15, shutter 390 is approximately a quarter disk plate which is rotated as motor 398 through gear 400 turns tube 392 and rod 386. When the plate covers one of openings 410 in upstream plate 411, exhaust gases flow through the other open openings and are filtered by the filter tubes in the corresponding quadrants. The filter tubes in the quadrant closed to exhaust gases by shutter 390 are available for regeneration. Sufficient exhaust gases with oxygen leak past closed shutter 390 to sustain regenerative combustion.

Figure 24:
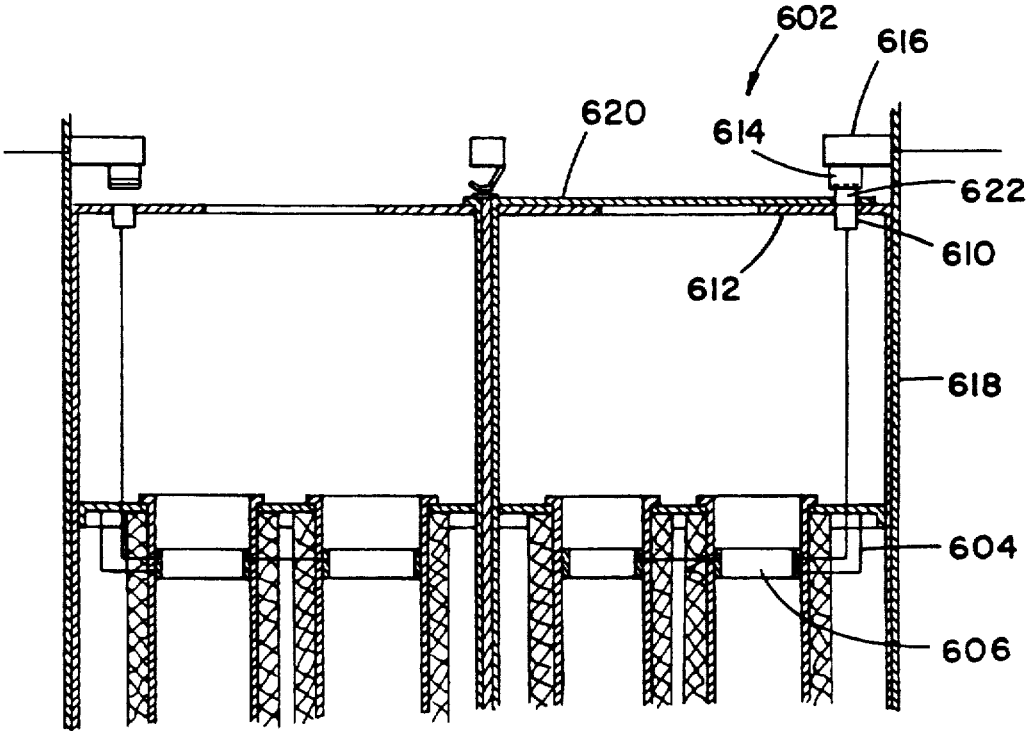
FIG. 24 is an alternate embodiment of the system of FIG. 14 wherein the shutter valve provides contact closure for energizing the heater elements.

The embodiments of FIGS. 11, 12, and 23 show poppet valve arrangements wherein the valve members function also to open or close contacts for energizing the heater element for a particular filter module. Shutter valve assembly 602 shown in FIG. 24 illustrates that a shutter valve can also be used to complete the electrical continuity for energizing the heater elements. One electrode 604 from heater 606 leads to an electrical ground. The other electrode via line 608 leads to a contact 610 in plate 612. A spring contact 614 is supported by a bracket 616 from the wall 618 of the assembly. Shutter 620 includes a contact 622 which as shutter 620 is rotated into a valve closure position completes electrical continuity between contact 610 and spring contact 614 via contact 622. A similar arrangement is provided for each quadrant and set of heating elements therein. Spring contact 616 is in continuity with the processor (not shown) and the system is adequately grounded as disclosed hereinbefore or known to those so skilled.

Muffler-filter apparatus 380 uses a tube valve for directing flow of exhaust gases through various filter tubes. Apparatus 380 includes a housing 412 comprising a cylindrical wall 414 with opposite end walls 416 and an interior baffle member 418. An inlet pipe 420 is formed in the end wall at one end of housing 412. Inlet pipe 420 is in fluid communication with engine 422 via line 424 to receive exhaust gases from the engine. Outlet pipe 426 is formed in the other end wall. An acoustic element in the form of a resonating chamber 428 is formed in the space between baffle 418 and the downstream end wall 416.

A second housing 430 is located between baffle 418 and the upstream end wall 416. Second housing 430 has upstream and downstream end walls 432 and 434 with a cylindrical side wall 436 extending therebetween. An axial tube 438 extends between the upstream and downstream end walls 432 and 434. Impermeable walls 440 extend between the end walls and tube 438 and cylindrical wall 436. Walls 440 divide second housing 430 into quadrants or more or less equal spaces to separate groups of filter tubes 442 from one another in the fashion adequately conveyed hereinbefore. Filter tubes 442 in the usual fashion are supported at the upstream end by a plate 444 and are closed at the downstream end, and are supported by a perforated plate 446.

Figure 17:
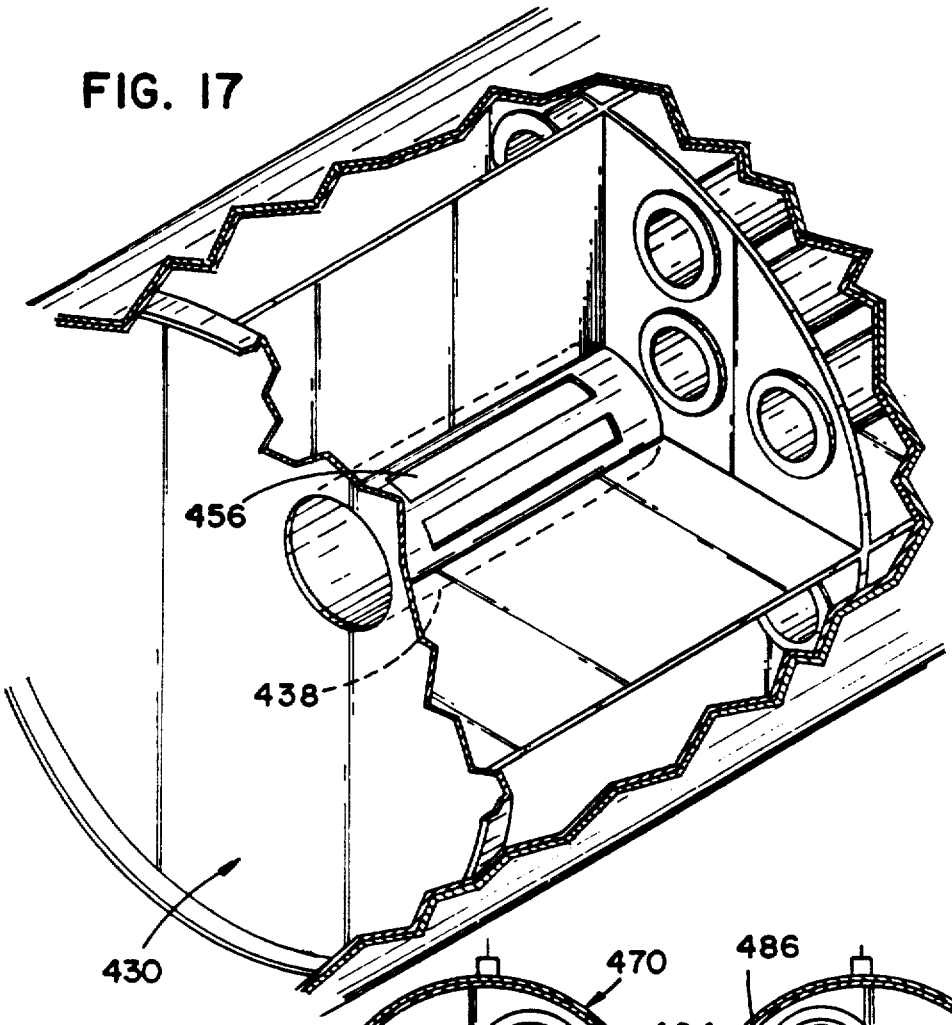
FIG. 17 is a partially cut-away perspective view of one end of a second housing as installed in the muffler-filter apparatus of FIG. 16.
Figure 19:
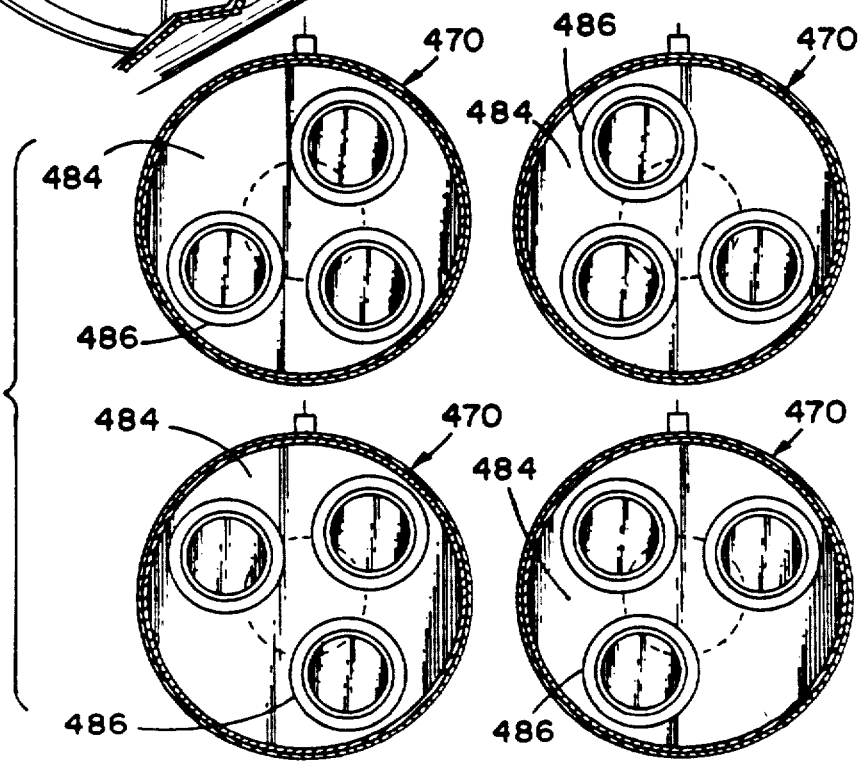
FIG. 19 is a cross-sectional view taken along line 19—19 of FIG. 18.

Tube valve assembly 448 directs the flow of exhaust gases through second housing 430. Tube valve assembly 448 includes a tube 450 which extends from inlet pipe 420 to outlet pipe 426. Tube 438 and inlet and outlet pipes 420 and 426 have the same interior diameters. Tube 450 has an outer diameter only slightly smaller so that it maintains a close fit, but is rotatable with respect to tube 438 and the inlet and outlet pipes. Tube 450 has one or more large openings 452 upstream of plate 444 and downstream of perforated plate 446 for each of three of the four quadrants. With respect to the fourth quadrant, tube 450 has small openings 454 upstream of plate 444 and downstream of perforated plate 446. Openings 452 and 454 register with similar openings 456 in tube 438 (see FIG. 17). A closure wall 458 separates the upstream and downstream openings 452 and 454 from one another. In this way, exhaust gases are directed through the larger openings and into second housing 430 for filtration of exhaust gases by the filter tubes in three of the quadrants. The fourth quadrant is substantially closed to exhaust gas flow except for a small amount of leakage through openings 454 which provide sufficient combustion oxygen for regeneration. Motor 460 rotates tube 450 as controlled by processor 462 via line 464. Processor 462 controls heating elements 466 via line 468.

Muffler-filter apparatus 382 shows a plurality of first housings 470 having inlet pipes 472 extending from a manifold 474. Each first housing 470 includes a second housing structure 476. Second housing structure 476 has upstream and downstream end walls 484 and 488 with a cylindrical side wall 482. End wall 484 supports filter tubes 486 at the upstream end, while a perforated end wall 488 supports the filter tubes at the downstream end.

A butterfly valve 494 is located in each leg of manifold 474 which leads to a different one of housings 470. Butterfly valves 494 are normally open. When a valve is closed, the filter tubes in the bypassed housing are available for regeneration. Butterfly valves 494 are controlled by a processor (not shown) via a line 496.

Figure 27:
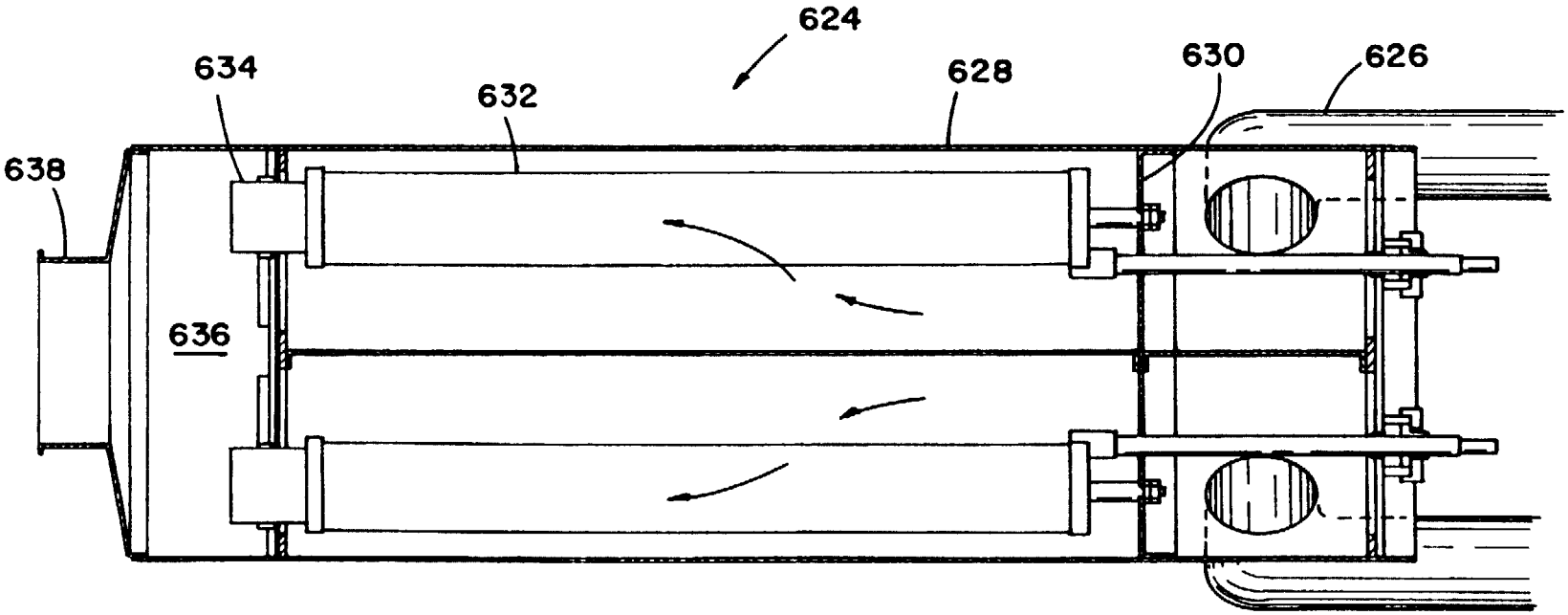
FIG. 27 illustrates another alternate embodiment exhaust system including a cross-sectional view of muffler-filter apparatus wherein exhaust gases flow through filter tubes from outside the filter material wall to inside.

An alternate embodiment muffler-filter apparatus 624 which can also be used with an external valve as just described is shown in FIG. 27. Apparatus 624 has inlet tubes 626 directing exhaust gases into different quadrants of housing 628. The exhaust gases in a quadrant flow through a perforated support plate 630 to a space external of filter tube module 632. The exhaust gases flow from outside the module to inside the module and exit from the downstream end 634 of the tube internal to module 632. The exhaust gases enter a plenum 636 for exhaust through outlet pipe 638.

Other System Embodiments

The use of fuel additives to reduce particulate combustion temperatures in diesel engine exhaust traps is well-known in the art. Such fuel additives as copper, iron, manganese, and cerium have been shown to be effective catalysts for reducing particulate combustion temperature. In the prior art, they have been used with a variety of ceramic traps, such as the monolithic style. The problem, however, with prior art systems is that regeneration can begin at exhaust temperatures below, but yet high relative to temperatures at which trap damage failing such as cracking or melting can occur. Since regeneration must take place while the engine is running, if exhaust flow is reduced (such as at idle) trap temperatures will increase since heat is not carried away as rapidly. The exotherm of the reaction can then reach run-away levels so that cracking or melting is to be expected.

The use of filters made from the various high temperature filter materials discussed hereinbefore alleviates the indicated problem by allowing the hot portions of the filter to expand freely. Particularly for fibrous filter tubes thermal stresses are not generated. Furthermore, the preferred ceramic fiber material sold under the NEXTEL trademark has higher ultimate temperature capabilities than common trap ceramics so that melting is much less likely. The result is that fuel additives used in a system which filters particulates using filter tubes made from high temperature materials, has performance substantially enhanced over prior art ceramic systems. In addition, when fuel additives are used as presently discussed, the system is essentially passive in nature, i.e., a control system is not necessary.

Figure 20:
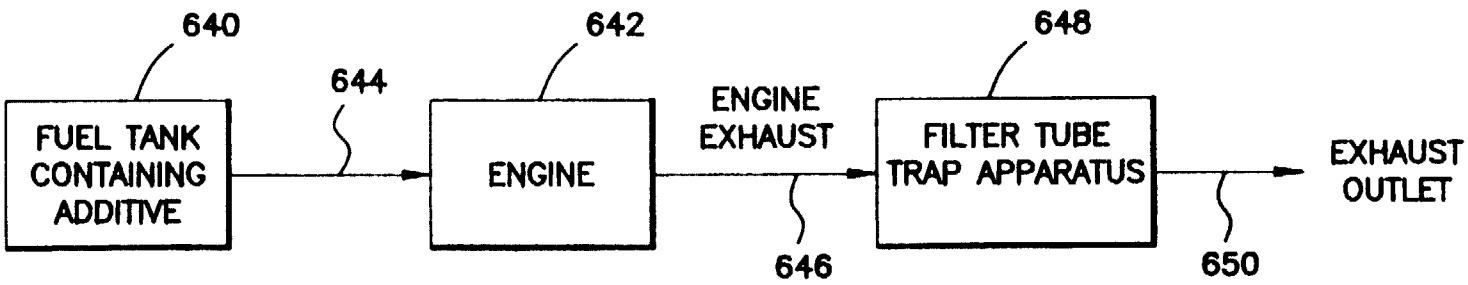
FIG. 20 is a block diagram illustrating an exhaust system using a fuel additive with tube filter apparatus.

Using a system as disclosed, for example, in FIG. 27, and assuming that no heating element and attendant control system is present, according to the present method, an engine is operated with a fuel and a particulate ignition temperature reducing fuel additive to create exhaust gases which include the additive. The exhaust gases are filtered through the ceramic fiber filter tubes to capture particulates and the additive before passing the gases to ambient. The filter tubes are regenerated as additive-laden particulates accumulate and are heated to the reduced ignition temperature by the exhaust gases. The fuel additive is preferably selected from a group comprising copper, iron, manganese, and cerium. As shown in FIG. 20, the fuel additive can be combined with the fuel in the general fuel supply as indicated by box 640. The fuel and additive mixture is directed to the engine 642 as indicated via line 644 for burning to create exhaust. The exhaust is directed as indicated via line 646 through the filter module 648 to an outlet 650.

Figure 21:
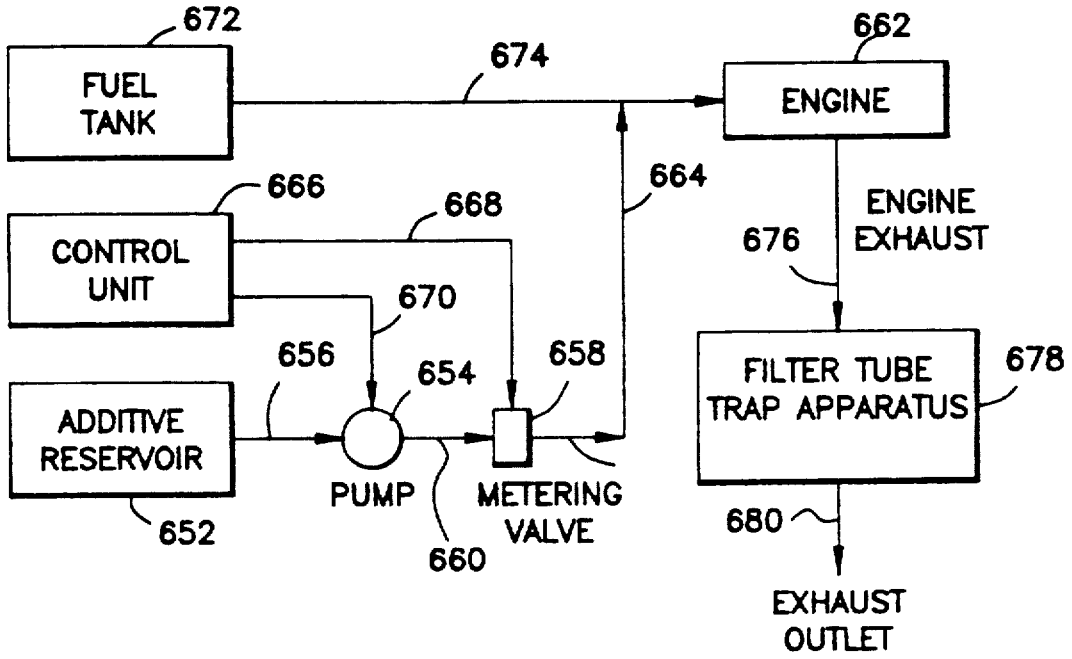
FIG. 21 is a block diagram illustrating an alternate embodiment of an exhaust system using a fuel additive.

Alternatively, as shown in FIG. 21, the additive may have its own reservoir or tank on the vehicle as indicated by box 652. The additive is pumped via pump 64 as indicated by line 656 through a metering valve 658 as indicated by line 660 to the engine 662 as indicated by line 664. The pump and metering valve are controlled by a control unit 666 as indicated by lines 668 and 670. The fuel is directed from a fuel tank 672 as indicated via line 674 to the engine. The engine burns the fuel and additive to create the exhaust gases which are directed as indicated by line 676 through filter tubes 678 to the exhaust outlet 680.

Thus, the fuel additive may be a part of the general fuel supply at the time fuel is directed into tanks on vehicles (FIG. 20) or the fuel and additives may separately be held by tanks on vehicles (FIG. 21) and separately directed to an engine. In any case, the additive is a useful catalyst for regeneration of the vehicle filter system.

As an alternative to fuel additives, exhaust or intake throttling with respect to an engine has been used to boost exhaust temperatures and initiate trap regeneration. This method is also known in the prior art. Typically, the throttle valve is controlled by a microprocessor which monitors exhaust temperature and modulates the throttle valve to a position which maintains temperature at a fixed level for a fixed time. This feedback control technique has been used to regenerate various ceramic traps. The present invention makes use of the throttling technique in conjunction with filter tubes of the types disclosed herein. This leads to a solution of the problems associated with monolithic ceramic prior art filters as discussed above. That is, with prior art systems in a full flow arrangement and a loaded trap, the exotherm can build to the point that should the exhaust flow decrease (such as at idle) the trap could achieve damaging temperatures to the point of thermal cracking or melting. For fiber filter tubes made from a large quantity of individual fibers and not a solid piece of ceramic, the presence of thermal stresses is not possible. The fibers are allowed to move with respect to each other so that as they heat up and expand, no damage to filter efficiency is possible due to cracking. Similarly, filter tubes of other high temperature materials, as discussed herein, are comparatively thin-walled and are also not subject to the degree of thermal stress of prior art monolithic ceramic systems. Furthermore, melting is also much less likely as earlier discussed.

Figure 22:
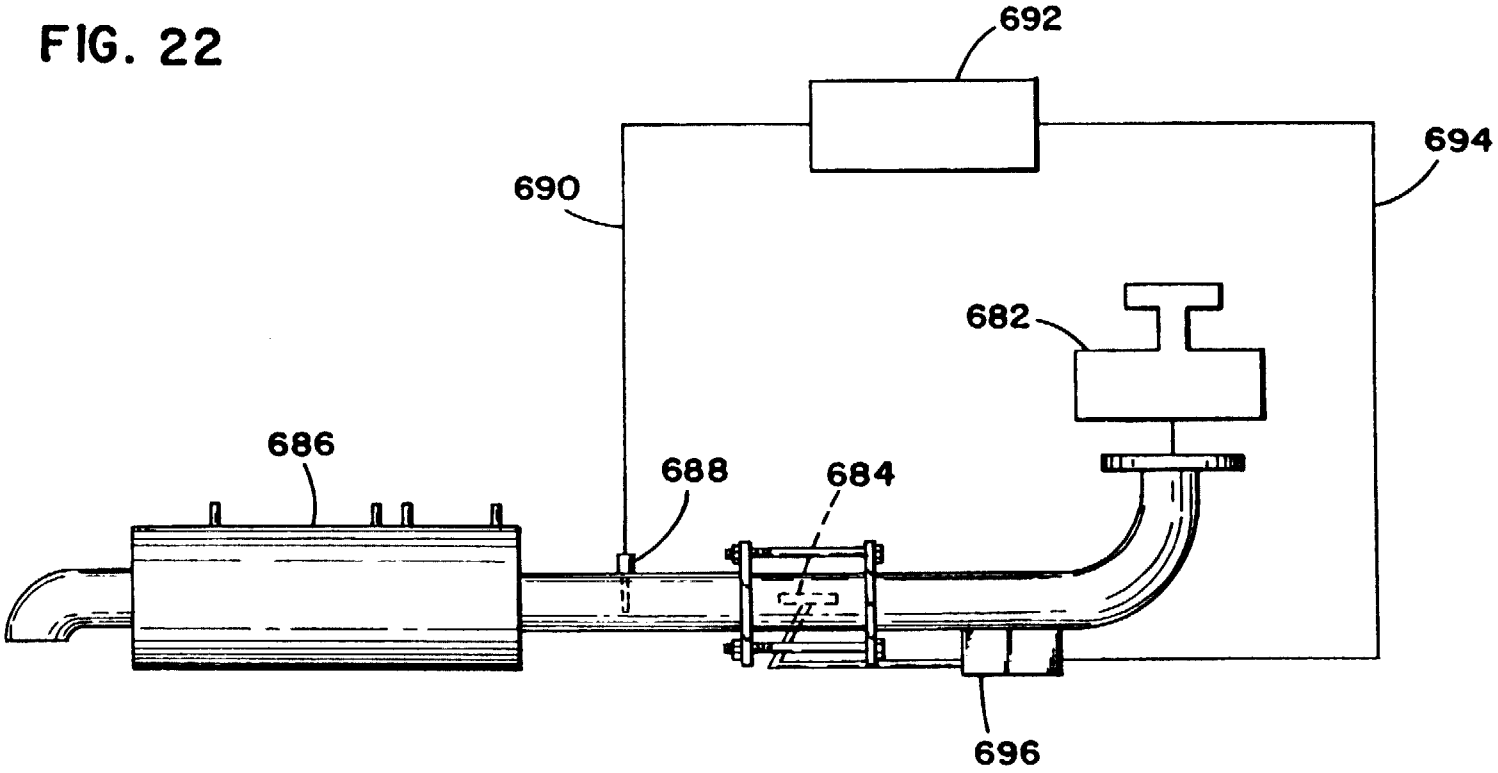
FIG. 22 is a front view of apparatus in accordance with FIG. 20.

A throttling system is illustrated in FIG. 22. An engine 682 directs exhaust gases past a throttle valve 684 to a housing 686 containing filter tubes. A temperature probe 688 sends information via line 690 to a microprocessor 692. The throttle valve 684 is then controlled by a feedback loop via line 694 controlling valve actuator 696.

To conclude, the present invention has been described in the form of many embodiments. It is understood, therefore, that the disclosure is representative and that equivalents are possible. In that regard, then, it is further understood that changes made, especially in matters of shape, size, and arrangement are within the principle of the invention to the full extent extended by the general meaning of the terms in which the appended claims are expressed.

What is claimed is:

1. Apparatus for processing exhaust gases from an engine, said apparatus comprising:

a housing receiving said exhaust gases at an upstream end and exhausting said exhaust gases from a common space through an outlet downstream;

a plurality of flow paths for said exhaust gases in a region between said inlet and said common space;

an arrangement of filter modules operably placed in said flow paths;

means with said exhaust gases flowing for selectively regenerating at any time at least one and less than all of said filter modules; and means for separating said exhaust gases upstream of said filter modules away from said one and less than all of said filter modules being regenerated and maintaining said exhaust gases separation from said one and less than all of said filter modules being regenerated until said exhaust gases flow to said common space.

2. Apparatus in accordance with claim 1 wherein each if said filtering means has a longitudinal axis and a filter material volume solidity sufficient to create more surface loading of particulates than depth loading, said regenerating means for each of said filtering means including means for igniting the particulates and propagating combustion axially.

3. Apparatus in accordance with claim 1 wherein each of said filtering means has a filter material volume solidity sufficient to create more depth loading of particulates than surface loading, said regenerating means for each of said filtering means including means for igniting said depth loading and combusting the particulates.

4. Apparatus in accordance with claim 1 wherein each of said filtering means has a longitudinal length and said regenerating means for each of said filtering means includes means spaced from said wall with filter material along substantially the entire longitudinal length for radiating heat toward said filter material to ignite and combust the particulates.

5. Apparatus in accordance with claim 1 wherein said regenerating means includes an exhaust gas throttle valve.

6. Apparatus in accordance with claim 1 wherein said filter module includes filter material to filter said particulates and tubular means for supporting said filter material;

an electrical heater having electrodes adapted to be energized to heat said particulates to combustion thereby regenerating said filter material, sad heater having an axis, said heater being spaced from and surrounded along said axis by said filter module; and means for controlling said heater.

7. Apparatus in accordance with claim 6 wherein said filter material includes a ceramic fiber yarn wound about said tubular supporting means.

8. Apparatus in accordance with claim 6 wherein said filter material includes a woven mat of fibers.

9. Apparatus in accordance with claim 6 wherein said filter material includes a mat formed from a non-woven, random array of fibers.

10. Apparatus in accordance with claim 8 wherein said mat includes a plurality of layers having a plurality of volume solidity values.

11. Apparatus in accordance with claim 9 wherein said mat includes a plurality of layers having a plurality of volume solidity values.

12. Apparatus in accordance with claim 6 wherein said filter material has opposite ends relative to said axis, said heater being in the form of a ring near one of said ends.

13. Apparatus in accordance with claim 6 wherein said filter material has opposite ends relative to said axis, said heater being in the form of a rod extending from near one of said ends toward the other.

14. Apparatus in accordance with claim 13 wherein said rod is in the form of a helix.

15. Apparatus in accordance with claim 13 wherein said rod is in the form of a perforated tube.

16. Apparatus in accordance with claim 13 wherein said supporting means includes said rod.

17. Apparatus in accordance with claim 16 wherein said supporting means includes a mesh surrounding said rod along said axis.

18. Apparatus in accordance with claim 17 wherein said rod is in the form of a helix.

19. Apparatus in accordance with claim 6 wherein said filter material has opposite ends relative to said axis, said heater being in the form of a wire mesh extending between said ends.

20. Apparatus in accordance with claim 6 wherein said supporting means includes a perforated tube surrounding said filter material.

21. Apparatus for processing exhaust gases from an engine, said apparatus comprising:

an enclosure having inlet means and outlet means for passing the exhaust gases;

means in the enclosure for segmenting flow of said exhaust gases into a plurality of fluid flow paths, said segmenting means including a valve which variously directs the flow among the paths, said segmenting means including an assembly with a plurality of openings, each of said openings leading to one of said flow paths, said valve including a shutter and means for directing said shutter to variously close one of said openings;

means for filtering said exhaust gases flowing along each of said paths, each of said filtering means being a module, each of said modules having an open interior for flow of exhaust gases and a wall with filter material;

means for supporting said modules relative to said housing so that each said wall with filter material has open space thereabout for flow of exhaust gases;

means for heating said filtering means in said one of said fluid flow paths closed by said shutter directing means to cause particulates accumulated thereon to combust thereby regenerating said filtering means in said one path; and means for controlling said valve and said heating means.

22. Apparatus in accordance with claim 21 wherein said enclosure includes a plurality of canisters, each of said canisters having an inlet tube leading from common manifold means.

23. Apparatus in accordance with claim 27 wherein said valve is tubular with first means for flow restriction upstream from said filtering means and second means for flow restriction downstream from said filtering means.

24. Apparatus in accordance with claim 21 wherein said controlling means includes a first electrical contact on said shutter and a second electrical contact on said assembly whereby said shutter variously opens and closes electrical continuity between said first and second contacts as said shutter opens and closes said openings thereby energizing said heater when said shutter closes one of said openings and likewise closes continuity between said first and second contacts.

25. Apparatus in accordance with claim 21 wherein said valve includes a member which is movable between closed and open positions, said member including electrical contacts which make and break electrical continuity energizing said heating means, respectively.

26. Apparatus in accordance with claim 25 wherein said member includes a heating element extending into the open interior of one of said modules.

27. Apparatus in accordance with claim 21 including means in said enclosure for bypassing said filtering means.

28. Apparatus in accordance with claim 27 wherein said bypassing means includes a pressure relief valve between said inlet means and said outlet means.

29. Apparatus in accordance with claim 21 wherein said supporting means includes a tube, one of said filtering means modules fitting within said tube.

30. A filter module for trap apparatus used to process exhaust gases from an engine, comprising:

tubular means for filtering particulates from said exhaust gases;

means, connected with said trap apparatus, for supporting said tubular filtering means, said supporting means including a tubular structural support closely adjacent said tubular filtering means; and electrical resistance means arranged in separation from said tubular filtering means for periodically radiating heat energy to said tubular filtering means and particulates accumulated therein to cause said particulates to combust;

thereby periodically regenerating said tubular filtering means without said radiating means deteriorating due to high temperature contact with said filtering means during particulates combustion.

31. The module in accordance with claim 30 including means for insulating one end of said tubular filtering means thereby closing said end to flow of exhaust gases and retaining that heat energy within said tubular filtering means.

* * * * *